US008852841B2

(12) United States Patent
Ashizawa et al.

(10) Patent No.: US 8,852,841 B2
(45) Date of Patent: Oct. 7, 2014

(54) TONER FOR ELECTROSTATIC IMAGE DEVELOPMENT

(71) Applicant: Kao Corporation, Chuo-ku (JP)

(72) Inventors: Takeshi Ashizawa, Wakayama (JP); Shogo Watanabe, Wakayama (JP); Takashi Kubo, Wakayama (JP); Norihiro Hirai, Wakayama (JP)

(73) Assignee: Kao Corporation, Chuo-ku (JP)

( * ) Notice: Subject to any disclaimer, the term of this patent is extended or adjusted under 35 U.S.C. 154(b) by 21 days.

(21) Appl. No.: 13/690,278

(22) Filed: Nov. 30, 2012

(65) Prior Publication Data

US 2013/0157192 A1 Jun. 20, 2013

(30) Foreign Application Priority Data

Dec. 15, 2011 (JP) ..... 2011-274488

(51) Int. Cl.
*G03G 9/08* (2006.01)
*G03G 9/087* (2006.01)
*G03G 9/097* (2006.01)

(52) U.S. Cl.
CPC ..... *G03G 9/08755* (2013.01); *G03G 9/09741* (2013.01); *G03G 9/0817* (2013.01); *G03G 9/081* (2013.01); *G03G 9/08795* (2013.01); *G03G 9/08797* (2013.01)
USPC ..... 430/137.2; 430/137.18; 430/109.4; 430/108.22

(58) Field of Classification Search
CPC ..... G03G 9/08755; G03G 9/09741
USPC ..... 430/108.22, 109.4, 137.18, 137.2
See application file for complete search history.

(56) References Cited

U.S. PATENT DOCUMENTS

| | | | | |
|---|---|---|---|---|
| 8,431,303 | B2 * | 4/2013 | Sacripante et al. | 430/109.4 |
| 2005/0074608 | A1 * | 4/2005 | Sawada et al. | 428/388 |

FOREIGN PATENT DOCUMENTS

| | | |
|---|---|---|
| JP | 4-70765 | 3/1992 |
| JP | 5-346686 | 12/1993 |
| JP | 2007-139812 | 6/2007 |
| JP | 2007-139813 | 6/2007 |

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

A method for producing a toner for electrostatic image development containing at least a resin binder and a charge control agent, including step 1: melt-kneading components containing a resin binder and a charge control agent to provide a melt-kneaded product; and step 2: pulverizing the melt-kneaded product, and classifying a pulverized product, wherein the resin binder contains a polyester A obtained by polycondensing an alcohol component containing 1,2-propanediol and a carboxylic acid component containing a rosin compound and an aliphatic dicarboxylic acid compound having 6 to 10 carbon atoms, wherein 1,2-propanediol is contained in the alcohol component of the polyester A in an amount of 85% by mol or more. The toner for electrostatic image development obtained by the method of the present invention can be suitably used in, for example, the development or the like of latent image formed in electrophotography, an electrostatic recording method, an electrostatic printing method, or the like.

18 Claims, No Drawings

TONER FOR ELECTROSTATIC IMAGE DEVELOPMENT

FIELD OF THE INVENTION

The present invention relates to a toner for electrostatic image development usable in developing latent images formed in, for example, electrophotography, an electrostatic recording method, an electrostatic printing method, or the like.

BACKGROUND OF THE INVENTION

In the recent years, it is desired to change resin binder raw materials for a toner for electrostatic image development to raw materials derived from natural materials, from the viewpoint of reducing environmental burdens.

For example, a toner that contains a resin binder containing a polyester having a softening point of 80° C. or higher and lower than 120° C., obtained by polycondensing an alcohol component containing 1,2-propanediol in an amount of 65% by mol or more of the divalent alcohol component, and a carboxylic acid component containing a purified rosin, has excellent low-temperature fixing ability, storage property and filming resistance, and also reduces the generation of odors, as disclosed in Japanese Patent Laid-Open No. 2007-139813.

In addition, a toner that contains a resin binder containing a polyester (A) having a softening point of from 120° to 160° C. and a polyester (B) having a softening point of 80° C. or higher and lower than 120° C., wherein the polyester (B) is a polyester obtained by polycondensing an alcohol component and a carboxylic acid component containing a purified rosin, has excellent low-temperature fixing ability, storage property and pulverizability, as disclosed in Japanese Patent Laid-Open No. 2007-139812.

A toner composition using as a binder a nonlinear crosslinked polyester resin of which alcohol component contains a dihydric alcohol, and an acid component contains a rosin, an unsaturated dicarboxylic acid having 4 to 10 carbon atoms, and other dicarboxylic acids in specified amounts, the nonlinear crosslinked polyester resin having specified softening point, glass transition temperature and tetrahydrofuran-insoluble component in specified ranges, has favorable pulverizability during toner production, and has excellent low-temperature fixing ability, offset resistance, blocking resistance or the like, as disclosed in Japanese Patent Laid-Open No. Hei-4-70765.

SUMMARY OF THE INVENTION

The present invention relates to:

[1] a method for producing a toner for electrostatic image development containing at least a resin binder and a charge control agent, including:

step 1: melt-kneading components containing a resin binder and a charge control agent to provide a melt-kneaded product; and step 2: pulverizing the melt-kneaded product, and classifying a pulverized product, wherein the resin binder contains a polyester A obtained by polycondensing an alcohol component containing 1,2-propanediol and a carboxylic acid component containing a rosin compound and an aliphatic dicarboxylic acid compound having 6 to 10 carbon atoms, wherein 1,2-propanediol is contained in the alcohol component of the polyester A in an amount of 85% by mol or more; and

[2] a toner for electrostatic image development containing at least a resin binder and a charge control agent, wherein the resin binder contains a polyester A obtained by polycondensing an alcohol component containing 1,2-propanediol and a carboxylic acid component containing a rosin compound and an aliphatic dicarboxylic acid compound having 6 to 10 carbon atoms, wherein 1,2-propanediol is contained in the alcohol component of the polyester A in an amount of 85% by mol or more.

DETAILED DESCRIPTION OF THE INVENTION

It is found that a resin binder as described in Japanese Patent Laid-Open No. 2007-139813 in which 1,2-propanediol is used in an alcohol component for a resin binder and a rosin compound is used for a carboxylic acid component has a disadvantage in that excessive pulverization is generated during the pulverizing step of the production steps of the toner, thereby lowering its yield.

The present invention relates to a method for obtaining a toner for electrostatic image development having excellent low-temperature fixing ability, high-temperature offset resistance and thermal-resistant storage property, with excellent pulverizability, specifically with a low pulverization pressure upon pulverization, thereby suppressing the amount of fine powders generated, and thereby giving a high pulverization and classification yield, and a toner for electrostatic image development obtained by the method.

According to the method of the present invention, a toner for electrostatic image development having excellent low-temperature fixing ability, high-temperature offset resistance and thermal-resistant storage property can be obtained, with excellent pulverizability, specifically with a low pulverization pressure upon pulverization, thereby suppressing the amount of fine powders generated, and thereby giving a high pulverization and classification yield.

These and other advantages of the present invention will be apparent from the following description.

The method for producing a toner of the present invention is a method characterized by including melt-kneading at least a resin binder and a charge control agent, and pulverizing the melt-kneaded product obtained, and classifying a pulverized product, wherein the resin binder contains a polyester obtained by polycondensing an alcohol component containing 1,2-propanediol and a carboxylic acid component containing a rosin compound and an aliphatic dicarboxylic acid compound having 6 to 10 carbon atoms, wherein 1,2-propanediol is contained in the alcohol component of the polyester A in an amount of 85% by mol or more, and the method of the present invention exhibits some effects such that a pulverization pressure upon pulverization is low, and the amount of fine powder generated is suppressed, so that the pulverization and classification yield is excellent.

The reasons why the effects as described above are exhibited are unsure, they are considered as follows. A toner containing a polyester containing 1,2-propanediol as an alcohol component and an aliphatic dicarboxylic acid compound having 6 to 10 carbon atoms as a carboxylic acid component contain an aliphatic backbone, which is a soft segment, in a large amount in the resin binder, so that the resin binder is provided with toughness, thereby suppressing localized pulverization in the pulverizing step. The carboxylic acid component of the polyester further contains a rosin compound, so that a monomer backbone of a rosin compound containing a branched structure in a larger amount forms the pulverization interface, and thereby pulverization is improved, whereby it is deduced that a pulverization pressure during the pulverization can be reduced. By the synergistic effects of suppressing the localized pulverization and reducing the pulverization pressure as described above, it is deduced that the amount of fine powder generated can be suppressed, and that the pulverization and classification yield is improved.

The toner obtained by the method of the present invention contains at least a resin binder and a charge control agent.

<Resin Binder>

The resin binder used in the present invention contains a polyester A obtained by polycondensing an alcohol component containing 1,2-propanediol and a carboxylic acid component containing a rosin compound and an aliphatic dicarboxylic acid compound having 6 to 10 carbon atoms, wherein 1,2-propanediol is contained in the alcohol component of the polyester A in an amount of 85% by mol or more.

The alcohol component usable in the present invention contains 1,2-propanediol, and the content of 1,2-propanediol is 85% by mol or more, preferably 90% by mol or more, more preferably 95% by mol or more, and even more preferably substantially 100% by mol, of the alcohol component of the polyester A, from the viewpoint of suppressing the amount of fine powder generated during pulverization, thereby improving the pulverization and classification yield, and from the viewpoint of improving heat-resistant storage property of the toner.

Here, in a case where the resin binder contains a plural number of polyester A's, the content can be obtained by the sum of products of the content of 1,2-propanediol in the alcohol component of each of the polyester A's and a weight percentage of each of the polyester A's.

In a case where the resin binder contains a plural polyesters, the content of 1,2-propanediol is preferably 85% by mol or more, more preferably 90% by mol or more, even more preferably 95% by mol or more, and even more preferably substantially 100% by mol, of the alcohol component of all the polyesters, from the viewpoint of suppressing the amount of fine powder generated during pulverization, thereby improving the pulverization and classification yield, and from the viewpoint of improving heat-resistant storage property of the toner. The phrase "all the polyesters" as used herein means "all the polyesters contained in the resin binder."

Here, the content of 1,2-propanediol of the alcohol component of all the polyesters can be obtained by the sum of products of the content of 1,2-propanediol in the alcohol component of each of the polyesters and a weight percentage of each of the polyesters.

The alcohol component other than 1,2-propanediol includes dihydric alcohols such as an alkylene oxide adduct of bisphenol A represented by the formula (I):

(I)

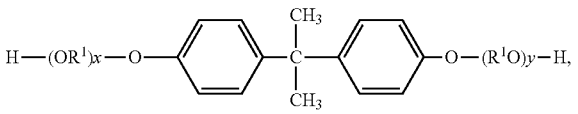

wherein $R^1O$ and $OR^1$ are an oxyalkylene group, wherein $R^1$ is an ethylene and/or propylene group, x and y each shows the number of moles of the alkylene oxide added, each being a positive number, and the sum of x and y on average is preferably from 1 to 16, more preferably from 1 to 8, and even more preferably from 1.5 to 4, and hydrogenated bisphenol A; and trihydric or higher polyhydric alcohols having 3 to 10 carbon atoms, such as sorbitol, 1,4-sorbitan, pentaerythritol, glycerol, and trimethylolpropane.

The carboxylic acid component of the polyester A contains a rosin compound and an aliphatic dicarboxylic acid compound having 6 to 10 carbon atoms.

The rosin compound refers to natural resins obtained from pine trees, of which main components are resin acids such as abietic acid, neoabietic acid, palustric acid, pimaric acid, isopimaric acid, sandaracopimaric acid, dehydroabietic acid, and levopimaric acid and mixtures thereof.

The kinds of the rosin compound are roughly classified into a tall rosin obtained from a tall oil obtainable as a by-product in the process of manufacturing a natural rosin pulp; a gum rosin obtainable from a crude turpentine, a wood rosin obtained from stumps of pine tree, and the like. The rosin compound used in the present invention is preferably a tall rosin, from the viewpoint of improving low-temperature fixing ability of the toner.

The rosin compounds are further classified into unpurified rosin compounds and purified rosin compounds. The unpurified rosin compounds refer to rosin compounds containing large amounts of impurities before purification, and the purified rosin compounds refer to rosins of which impurities are reduced by the purification steps. The main impurities include 2-methylpropane, acetaldehyde, 3-methyl-2-butanone, 2-methylpropanoic acid, butanoic acid, pentanoic acid, n-hexanal, octane, hexanoic acid, benzaldehyde, 2-pentylfuran, 2,6-dimethylcyclohexanone, 1-methyl-2-(1-methylethyl)benzene, 3,5-dimethyl-2-cyclohexene, 4-(1-methylethyl)benzaldehyde, and the like. In the present invention, peak intensities of three kinds of impurities of those listed above, hexanoic acid, pentanoic acid, and benzaldehyde, which are detected as volatile components according to headspace GC-MS method, can be used as indexes for a purified rosin.

Specifically, the purified rosin in the present invention refers to a rosin in which a peak intensity of hexanoic acid is $0.7\times10^7$ or less, a peak intensity of pentanoic acid is $0.5\times10^7$ or less, and a peak intensity of benzaldehyde is $0.4\times10^7$ or less, under measurement conditions for headspace GC-MS method described later. Further, from the viewpoint of improving heat-resistant storage property of the toner and from the viewpoint of reducing odor, the peak intensity of hexanoic acid is preferably $0.6\times10^7$ or less, and more preferably $0.5\times10^7$ or less. The peak intensity of pentanoic acid is preferably $0.4\times10^7$ or less, and more preferably $0.3\times10^7$ or less. The peak intensity of benzaldehyde is preferably $0.3\times10^7$ or less, and more preferably $0.2\times10^7$ or less.

Further, it is preferable that n-hexanal and 2-pentylfuran are reduced in addition to the three kinds of substances mentioned above, from the viewpoint of improving heat-resistant storage property of the toner and from the viewpoint of reducing odor. The peak intensity of n-hexanal is preferably $1.7\times10^7$ or less, more preferably $1.6\times10^7$ or less, and even more preferably $1.5\times10^7$ or less. In addition, the peak intensity of 2-pentylfuran is preferably $1.0\times10^7$ or less, more preferably $0.9\times10^7$ or less, and even more preferably $0.8\times10^7$ or less.

As a method of purifying a rosin, a known method can be utilized, and the method includes a method by distillation, recrystallization, extraction or the like, and it is preferable that the rosin is purified by distillation. As a method of distillation, a method described, for example, in Japanese Patent Laid-Open No. Hei-7-286139 can be utilized. The method of distillation includes vacuum distillation, molecular distillation, steam distillation, and the like, and it is preferable that the rosin is purified by vacuum distillation. For example, distillation is carried out usually at a pressure of 6.67 kPa or less and at a stilling temperature of from 200° to 300° C., an ordinary simple distillation as well as a method of thin-film distillation, fractionation, or the like can be applied. The high-molecular weight compound is removed as a pitch component in an amount of from 2 to 10% by weight, and at the same time an initial distillate is removed in an amount of from 2 to 10% by weight, each based on the charged rosin under ordinary distillation conditions.

Further, as the rosin compound, a modified rosin compound can also be used. The modified rosin in the present invention refers to a modified rosin obtained by an addition reaction of acrylic acid, methacrylic acid, fumaric acid, maleic acid or the like, to a rosin of which main component is abietic acid, neoabietic acid, palustric acid, pimaric acid, isopimaric acid, sandaracopimaric acid, dehydroabietic acid, and levopimaric acid. Specifically, the modified rosin is obtained through a Diels-Alder reaction between levopimaric acid, abietic acid, neoabietic acid, and palustric acid, having a conjugated double bond in the main component of the rosin, and a compound having an unsaturated bond such as acrylic acid, methacrylic acid, fumaric acid, or maleic acid while heating.

The rosin compound used in the present invention is preferably an unmodified rosin compound, from the viewpoint of improving low-temperature fixing ability and heat-resistant storage property of the toner. Also, the unpurified rosin or the purified rosin may be used, from the viewpoint of reducing a pulverization pressure during pulverization, and suppressing the amount of fine powders generated, thereby improving the pulverization and classification yield, and from the viewpoint of improving heat-resistant storage property of the toner.

The rosin compound has a softening point of preferably from 50° to 100° C., more preferably from 60° to 90° C., and even more preferably from 65° to 85° C., from the viewpoint of improving high-temperature offset resistance and low-temperature fixing ability of the toner. The softening point of the rosin compound can be measured by a method described in Examples set forth below.

The rosin compound has an acid value of preferably from 100 to 200 mg KOH/g, more preferably from 130 to 180 mg KOH/g, and even more preferably from 150 to 170 mg KOH/g, from the viewpoint of improving high-temperature offset resistance and heat-resistant storage property of the toner.

The rosin compound has a flash point of preferably from 180° to 240° C., more preferably from 185° to 230° C., and even more preferably from 190° C. to 220° C., from the viewpoint of improving low-temperature fixing ability of the toner and from the viewpoint of reducing odors.

The content of the rosin compound is preferably 2.0% by mol or more, more preferably 2.5% by mol or more, and even more preferably 3.0% by mol or more, of the carboxylic acid component of the polyester A, from the viewpoint of reducing a pulverization pressure during pulverization, and suppressing the amount of fine powders generated, thereby improving the pulverization and classification yield, and from the viewpoint of improving heat-resistant storage property of the toner. On the other hand, the content of the rosin compound is preferably 30% by mol or less, more preferably 25% by mol or less, even more preferably 15% by mol or less, and still even more preferably 7% by mol or less, of the carboxylic acid component of the polyester A, from the viewpoint of suppressing the amount of fine powders generated, thereby improving the pulverization and classification yield, and from the viewpoint of improving heat-resistant storage property of the toner. From these viewpoints taken together, the content of the rosin compound is preferably from 2.0 to 30% by mol, more preferably from 2.5 to 25% by mol, even more preferably from 3.0 to 15% by mol, and still even preferably from 3.0 to 7% by mol, of the carboxylic acid component of the polyester A.

Here, in a case where the resin binder contains a plural number of polyester A's, the content of the rosin compound can be obtained by the sum of products of the content of the rosin compound in each of the polyester A's and a weight percentage of each of the polyester A's.

The content of the rosin compound is preferably 2.0% by mol or more, more preferably 2.5% by mol or more, and even more preferably 3.0% by mol or more, of the carboxylic acid component of all the polyesters, from the viewpoint of reducing a pulverization pressure during pulverization and suppressing the amount of fine powders generated, thereby improving the pulverization and classification yield, and from the viewpoint of improving heat-resistant storage property of the toner. On the other hand, the content of the rosin compound is preferably 25% by mol or less, more preferably 20% by mol or less, even more preferably 15% by mol or less, still even more preferably 10% by mol or less, and still even more preferably 7% by mol or less, of the carboxylic acid component of all the polyesters, from the viewpoint of suppressing the amount of fine powders generated, thereby improving the pulverization and classification yield, and from the viewpoint of improving heat-resistant storage property of the toner. From these viewpoints taken together, the content of the rosin compound is preferably from 2.0 to 25% by mol, more preferably from 2.5 to 20% by mol, even more preferably from 3.0 to 15% by mol, still even more preferably from 3.0 to 10% by mol, and still even more preferably from 3.0 to 7% by mol, of the carboxylic acid component of all the polyesters.

Here, the content of the rosin compound in the carboxylic acid component of all the polyesters can be obtained by the sum of products of the content of the rosin compound in the carboxylic acid component of each of the polyesters and a weight percentage of each of the polyesters.

The aliphatic dicarboxylic acid compound having 6 to 10 carbon atoms is preferably one or more members selected from the group consisting of sebacic acid compounds and adipic acid compounds, one or more members selected from the group consisting of sebacic acid and adipic acid are more preferred. Sebacic acid is even more preferred, from the viewpoint of suppressing the amount of fine powders generated, thereby improving the pulverization and classification yield. Here, the carboxylic acid compounds refer to carboxylic acids, and derivatives such as acid anhydrides thereof, and alkyl(1 to 4 carbon atoms) ester thereof. Preferred number of carbon atoms means the number of carbon atoms of the carboxylic acid moiety of the carboxylic acid compound.

The content of the aliphatic dicarboxylic acid compound having 6 to 10 carbon atoms is preferably 0.5% by mol or more, more preferably 1.5% by mol or more, even more preferably 2.0% by mol or more, and still even more preferably 3.0% by mol or more, of the carboxylic acid component of the polyester A, from the viewpoint of suppressing the amount of fine powders generated, thereby improving the pulverization and classification yield, and from the viewpoint of improving low-temperature fixing ability and high-temperature offset resistance of the toner. On the other hand, the content of the aliphatic dicarboxylic acid compound having 6 to 10 carbon atoms is preferably 9% by mol or less, more preferably 7% by mol or less, even more preferably 5.5% by mol or less, and still even more preferably 4.5% by mol or less, of the carboxylic acid component of the polyester A, from the viewpoint of reducing a pulverization pressure during pulverization and from the viewpoint of improving heat-resistant storage property of the toner. From these viewpoints taken together, the content of the aliphatic dicarboxylic acid compound having 6 to 10 carbon atoms is preferably from 0.5 to 9% by mol, more preferably from 1.5 to 7% by mol, even more preferably from 2.0 to 5.5% by mol, and still even more preferably from 3.0 to 4.5% by mol, of the carboxylic acid component of the polyester A.

In addition, the content of the aliphatic dicarboxylic acid compound having 6 to 10 carbon atoms is preferably from 0.5 to 4.5% by mol, and more preferably from 0.5 to 3.0% by mol, of the carboxylic acid component of the polyester A, from the viewpoint of reducing a pulverization pressure during pulverization and from the viewpoint of improving heat-resistant storage property of the toner.

Alternatively, the content of the aliphatic dicarboxylic acid compound having 6 to 10 carbon atoms is preferably from 4.5 to 9% by mol, and more preferably from 4.5 to 7% by mol, of the carboxylic acid component of the polyester A, from the viewpoint of suppressing the amount of fine powders generated, from the viewpoint of improving the pulverization yield, and from the viewpoint of low-temperature fixing ability of the toner.

In addition, the content of the aliphatic dicarboxylic acid compound having 6 to 10 carbon atoms is preferably from 3.0 to 9% by mol, and more preferably from 5.5 to 7% by mol, of the carboxylic acid component of the polyester A, from the viewpoint of improving high-temperature offset resistance of the toner.

Here, in a case where the resin binder contains a plural number of polyester A's, the content of the aliphatic dicarboxylic acid compound having 6 to 10 carbon atoms is obtained by the sum of products of the content of the aliphatic dicarboxylic acid compound having 6 to 10 carbon atoms in each of the polyester A's and a weight percentage of each of the polyester A's.

The content of the aliphatic dicarboxylic acid compound having 6 to 10 carbon atoms is preferably 0.5% by mol or more, more preferably 1.5% by mol or more, even more preferably 2.0% by mol or more, and still even more preferably 2.5% by mol or more, of the carboxylic acid component of all the polyesters, from the viewpoint of suppressing the amount of fine powders generated, thereby improving the pulverization and classification yield, and from the viewpoint of improving low-temperature fixing ability and high-temperature offset resistance of the toner. On the other hand, the content of the aliphatic dicarboxylic acid compound having 6 to 10 carbon atoms is preferably 8% by mol or less, more preferably 6% by mol or less, even more preferably 4.5% by mol or less, and still even more preferably 3.5% by mol or less, of the carboxylic acid component of all the polyesters, from the viewpoint of reducing a pulverization pressure during pulverization and from the viewpoint of improving heat-resistant storage property of the toner. From these viewpoints taken together, the content of the aliphatic dicarboxylic acid compound having 6 to 10 carbon atoms is preferably from 0.5 to 8% by mol, more preferably from 1.5 to 6% by mol, even more preferably from 2.0 to 4.5% by mol, and still even more preferably from 2.5 to 3.5% by mol, of the carboxylic acid component of all the polyesters.

In addition, the content of the aliphatic dicarboxylic acid compound having 6 to 10 carbon atoms is preferably from 0.5 to 3.5% by mol, and more preferably from 0.5 to 2.5% by mol, of the carboxylic acid component of all the polyesters, from the viewpoint of reducing a pulverization pressure during pulverization and from the viewpoint of improving heat-resistant storage property of the toner.

The content of the aliphatic dicarboxylic acid compound having 6 to 10 carbon atoms is preferably from 3.5 to 8% by mol, and more preferably from 3.5 to 6% by mol, of the carboxylic acid component of all the polyesters, from the viewpoint of suppressing the amount of fine powders generated, thereby improving the pulverization yield, and from the viewpoint of improving low-temperature fixing ability of the toner.

Also, the content of the aliphatic dicarboxylic acid compound having 6 to 10 carbon atoms is preferably from 2.5 to 8% by mol, and more preferably from 4.5 to 6% by mol, of the carboxylic acid component of all the polyesters, from the viewpoint of improving high-temperature offset resistance of the toner.

Here, the content of the aliphatic dicarboxylic acid compound having 6 to 10 carbon atoms in the carboxylic acid component of all the polyesters can be obtained by the sum of products of the content of the aliphatic dicarboxylic acid compound having 6 to 10 carbon atoms in the carboxylic acid component of each of the polyesters and a weight percentage of each of the polyesters.

The carboxylic acid component other than the rosin compound and the aliphatic dicarboxylic acid compound having 6 to 10 carbon atoms includes aliphatic dicarboxylic acid compounds having 3 to 5 carbon atoms such as fumaric acid, maleic acid, succinic acid, and glutaric acid; aliphatic dicarboxylic acid compounds having 11 to 24 carbon atoms such as succinic acid compounds substituted by an alkyl group or alkenyl group having 7 to 20 carbon atoms; aromatic dicarboxylic acid compounds such as phthalic acid, isophthalic acid, and terephthalic acid; tricarboxylic or higher polycarboxylic acid compounds having 4 to 10 carbon atoms such as 1,2,4-benzenetricarboxylic acid, i.e. trimellitic acid, and 1,2,4,5-benzenetetracarboxylic acid, i.e. pyromellitic acid. Among them, the aromatic dicarboxylic acid compound and the aromatic tricarboxylic acid compound are preferred, and terephthalic acid and trimellitic anhydride are more preferred, from the viewpoint of improving triboelectric stability and heat-resistant storage property of the toner.

The content of the aromatic dicarboxylic acid compound is preferably from 50 to 94.5% by mol, more preferably from 60 to 92% by mol, and even more preferably from 70 to 85% by mol, of the carboxylic acid component of the polyester A, from the viewpoint of improving triboelectric stability and heat-resistant storage property of the toner.

The content of the aromatic tricarboxylic acid compound is preferably from 3 to 20% by mol, more preferably from 5 to 17% by mol, and even more preferably from 10 to 14% by mol, of the carboxylic acid component of the polyester A, from the viewpoint of improving low-temperature fixing ability, high-temperature offset resistance, and heat-resistant storage property of the toner.

Here, in a case where the resin binder contains a plural number of polyester A's, the content of the aromatic dicarboxylic acid compound and the aromatic tricarboxylic acid compound can be each obtained by the sum of products of the content of each of the compounds in each of the polyester A's and a weight percentage of each of the polyester A's.

Also, the alcohol component may properly contain a monohydric alcohol, and the carboxylic acid component may properly contain a monocarboxylic acid compound, from the viewpoint of adjusting the softening point of the polyester.

The carboxylic acid component and the alcohol component in the polyester are in an equivalent ratio, i.e. COOH group or groups/OH group or groups, of preferably from 0.70 to 1.10, and more preferably from 0.75 to 1.00, from the viewpoint of reducing an acid value of the polyester A.

The polycondensation reaction of the alcohol component and the carboxylic acid component can be carried out by polycondensing the components in an inert gas atmosphere at a temperature of from 180° to 250° C. or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter includes gallic acid, and the like. The esterification catalyst is used in an amount of preferably from 0.01 to 1.5 parts by weight, and more preferably from 0.1 to 1.0 part by weight, based on 100 parts by weight of a total amount of the alcohol component and the carboxylic acid component. The esterification promoter is used in an amount of preferably from 0.001 to 0.5 parts by weight, and more preferably from 0.01 to 0.1 parts by weight, based on 100 parts by weight of a total amount of the alcohol component and the carboxylic acid component.

The polyester A has a softening point of preferably from 90° to 155° C., more preferably from 125° to 155° C., and even more preferably from 130° to 150° C., from the viewpoint of improving low-temperature fixing ability and high-temperature offset resistance of the toner.

Here, in a case where the resin binder contains a plural number of polyester A's, it is preferable that the sum of products of the softening points of each of the polyester A's and a weight percentage of each of the polyester A's falls within the above range.

The softening point of the polyester A can be controlled by adjusting the kinds and compositional ratios of the alcohol component and the carboxylic acid component, an amount of catalyst, or the like, or selecting reaction conditions such as reaction temperature, reaction time and reaction pressure.

The polyester A has a glass transition temperature of preferably from 50° to 80° C., and more preferably from 55° to 70° C., from the viewpoint of improving low-temperature fixing ability and storage stability of the toner.

The glass transition temperature of the polyester A can be controlled by the kinds and compositional ratios of the alcohol component and the carboxylic acid component, and the like.

Here, in a case where the resin binder contains a plural number of polyester A's, it is preferable that the sum of products of the glass transition temperatures of each of the polyester A's and a weight percentage of each of the polyester A's falls within the above range.

The polyester A has an acid value of preferably 30 mg KOH/g or less, and more preferably 25 mg KOH/g or less, from the viewpoint of improving triboelectric stability, heat-resistant storage property and high-temperature offset resistance of the toner.

The acid value of the polyester A can be controlled by adjusting the kinds and compositional ratios of the alcohol component and the carboxylic acid component, an amount of catalyst, or the like, or selecting reaction conditions such as reaction temperature, reaction time and reaction pressure.

It is preferable that the resin binder used in the present invention contains two or more kinds of polyesters having different softening points, from the viewpoint of improving low-temperature fixing ability and high-temperature offset resistance of the toner.

A polyester H having a higher softening point and a polyester L having a lower softening point have a difference in softening points of preferably 10° C. or more, more preferably from 20° to 60° C., and even more preferably from 30° to 50° C., from the viewpoint of improving low-temperature fixing ability and high-temperature offset resistance of the toner.

The polyester H has a softening point of preferably from 125° to 155° C., and more preferably from 130° to 150° C., from the viewpoint of reducing a pulverization pressure during pulverization and suppressing the amount of fine powders generated, thereby improving the pulverization and classification yield, and from the viewpoint of improving low-temperature fixing ability, high-temperature offset resistance and heat-resistant storage property of the toner.

Here, in a case where the resin binder contains a plural number of polyester H's, it is preferable that the sum of products of the softening points of each of the polyester H's and a weight percentage of each of the polyester H's falls within the above range, and it is more preferable that each of the polyesters falls within the above range.

The polyester L has a softening point of preferably from 90° to 125° C., and more preferably from 90° to 110° C., from the viewpoint of reducing a pulverization pressure during pulverization and suppressing the amount of fine powders generated, thereby improving the pulverization and classification yield, and from the viewpoint of improving low-temperature fixing ability, high-temperature offset resistance and heat-resistant storage property of the toner.

Here, in a case where the resin binder contains a plural number of polyester L's, it is preferable that the sum of products of the softening points of each of the polyester L's and a weight percentage of each of the polyester L's falls within the above range, and it is more preferable that each of the polyesters falls within the above range.

The softening point of the polyester can be controlled by adjusting the kinds and compositional ratios of the alcohol component and the carboxylic acid component, an amount of catalyst, or the like, or selecting reaction conditions such as reaction temperature, reaction time and reaction pressure.

In the resin binder used in the present invention, at least one of the polyester H and the polyester L is preferably a polyester A, from the viewpoint of reducing a pulverization pressure during pulverization. It is more preferable that the polyester H is a polyester A, from the viewpoint of improving heat-resistant storage property of the toner.

Alternatively, it is preferable that both the polyester H and the polyester L are polyester A's, from the viewpoint of suppressing the amount of fine powders generated, thereby improving the pulverization and classification yield, and from the viewpoint of improving low-temperature fixing ability and high-temperature offset resistance of the toner.

Further, it is more preferable that the polyester L is a polyester B obtained by polycondensation of an alcohol component containing 1,2-propanediol, and a carboxylic acid component containing a rosin compound and not containing an aliphatic dicarboxylic acid compound having 6 to 10 carbon atoms, from the viewpoint of improving heat-resistant storage property of the toner.

Preferred embodiments of the alcohol component of the polyester B are the same as those of the alcohol component of the polyester A.

In the carboxylic acid component of the polyester B, the preferred embodiments of the kinds and physical properties and the like of the rosin compound, and the content in the carboxylic acid component of the polyester B are the same as those in the carboxylic acid component of the polyester A.

It is preferable that the carboxylic acid component of the polyester B does not contain an aliphatic dicarboxylic acid compound having 6 to 10 carbon atoms, and if contained, the content of the aliphatic dicarboxylic acid compound is preferably 1% by mol or less, more preferably 0.1% by mol or less, and even more preferably 0.01% by mol or less, of the carboxylic acid component.

The carboxylic acid component other than the rosin compound is the same as those in the carboxylic acid component of the polyester A, except that it is preferred not to contain the aliphatic dicarboxylic acid compound having 6 to 10 carbon atoms, and the other carboxylic acid components are preferably an aromatic dicarboxylic acid compound and an aromatic tricarboxylic acid compound, and more preferably terephthalic acid and trimellitic anhydride, from the viewpoint of improving triboelectric stability and heat-resistant storage property of the toner.

The content of the aromatic dicarboxylic acid compound is preferably from 50 to 95% by mol, more preferably from 80 to 95% by mol, and even more preferably from 85 to 95% by mol, of the carboxylic acid component of the polyester B, from the viewpoint of improving triboelectric stability, heat-resistant storage property and high-temperature offset resistance.

The content of the aromatic tricarboxylic acid compound is preferably from 3 to 20% by mol, more preferably from 3 to 15% by mol, and even more preferably from 3 to 6% by mol, of the carboxylic acid component of the polyester B, from the viewpoint of improving low-temperature fixing ability and high-temperature offset resistance of the toner, and from the viewpoint of improving heat-resistant storage property.

Here, in a case where the resin binder contains a plural number of polyester B's, the content of the aromatic dicarboxylic acid compound and the aromatic tricarboxylic acid compound can be each obtained by the sum of products of the content of each of the compounds in each of the polyester B's and a weight percentage of each of the polyester B's.

Preferred embodiments of the equivalent ratio of the carboxylic acid component to the alcohol component in the polyester B, and a production method thereof are the same as those in the polyester A.

The polyester B has a softening point of preferably from 90° to 155° C., more preferably from 90° to 125° C., and even more preferably from 90° to 110° C., from the viewpoint of improving low-temperature fixing ability and high-temperature offset resistance of the toner.

Here, in a case where the resin binder contains a plural number of polyester B's, it is preferable that the sum of products of the softening points of each of the polyester B's and a weight percentage of each of the polyester B's falls within the above range.

The softening point of the polyester B can be controlled by adjusting the kinds and compositional ratios of the alcohol component and the carboxylic acid component, an amount of catalyst, or the like, or selecting reaction conditions such as reaction temperature, reaction time and reaction pressure.

The polyester B has a glass transition temperature of preferably from 50° to 80° C., and more preferably from 55° to 65° C., from the viewpoint of improving low-temperature fixing ability and storage stability of the toner.

Here, in a case where the resin binder contains a plural number of polyester B's, it is preferable that the sum of products of the glass transition temperatures of each of the polyester B's and a weight percentage of each of the polyester B's falls within the above range.

The glass transition temperature of the polyester B can be controlled by the kinds and compositional ratios of the alcohol component and the carboxylic acid component, or the like.

The polyester B has an acid value of preferably 30 mg KOH/g or less, and more preferably 25 mg KOH/g or less, from the viewpoint of improving triboelectric stability, heat-resistant storage property and high-temperature offset resistance of the toner.

The acid value of the polyester B can be controlled by adjusting the kinds and compositional ratios of the alcohol component and the carboxylic acid component, an amount of catalyst, or the like, or selecting reaction conditions such as reaction temperature, reaction time and reaction pressure.

The content of the polyester A is preferably from 30 to 95% by weight, more preferably from 40 to 90% by weight, even more preferably from 45 to 90% by weight, still even more preferably from 50 to 85% by weight, still even more preferably from 50 to 80% by weight, and still even more preferably from 55 to 80% by weight, of the resin binder, from the viewpoint of reducing a pulverization pressure during pulverization and suppressing the amount of fine powders generated, thereby improving the pulverization and classification yield, and from the viewpoint of improving low-temperature fixing ability, high-temperature offset resistance and heat-resistant storage property of the toner.

The content of the polyester B is preferably from 5 to 70% by weight, more preferably from 10 to 60% by weight, even more preferably from 10 to 55% by weight, still even more preferably from 15 to 50% by weight, still even more preferably from 20 to 50% by weight, and still even more preferably from 20 to 45% by weight, of the resin binder, from the viewpoint of reducing a pulverization pressure during pulverization and suppressing the amount of fine powders generated, thereby improving the pulverization and classification yield, and from the viewpoint of improving low-temperature fixing ability, high-temperature offset resistance and heat-resistant storage property of the toner.

The resin binder may contain other resins besides the polyester A and the polyester B within the range that would not impair the effects of the present invention. A total content of the polyester A and the polyester B is preferably 80% by weight or more, more preferably 90% by weight or more, even more preferably 95% by weight or more, and still even more preferably substantially 100% by weight, of the resin binder, from the viewpoint of reducing a pulverization pressure during pulverization and suppressing the amount of fine powders generated, thereby improving the pulverization and classification yield, and from the viewpoint of improving low-temperature fixing ability, high-temperature offset resistance and heat-resistant storage property of the toner. Other resin binders include polyesters other than the polyester A and the polyester B, vinyl resins, epoxy resins, polycarbonates, polyurethanes, and the like.

The polyester A and the polyester B are in a weight ratio, i.e. polyester A/polyester B, of preferably from 30/70 to 95/5, more preferably from 40/60 to 90/10, even more preferably from 45/55 to 90/10, still even more preferably from 50/50 to 85/15, still even more preferably from 50/50 to 80/20, and still even more preferably from 55/45 to 80/20, from the viewpoint of reducing a pulverization pressure during pulverization and suppressing the amount of fine powders generated, thereby improving the pulverization and classification yield, and from the viewpoint of improving low-temperature fixing ability, high-temperature offset resistance and heat-resistant storage property of the toner.

The polyester A and the polyester B are in a weight ratio of more preferably from 30/70 to 65/35, from the viewpoint of reducing a pulverization pressure during pulverization. The polyester A and the polyester B are in a weight ratio of more preferably from 50/50 to 95/5, and even more preferably from 80/20 to 95/5, from the viewpoint of suppressing the amount of fine powders generated, thereby improving the pulverization and classification yield, and from the viewpoint of improving high-temperature offset resistance and heat-resistant storage property of the toner. Also, the polyester A and the polyester B are in a weight ratio of more preferably from 30/70 to 80/20, and even more preferably from 30/70 to 50/50, from the viewpoint of improving low-temperature fixing ability of the toner.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in Japanese Patent Laid-Open Nos. Hei-11-133668, Hei-10-239903, Hei-8-20636, or the like.

<Charge Control Agent>

The charge control agent may be any of positively chargeable charge control agents and negatively chargeable charge control agents, and in color toners, it is preferable to use a charge control agent that does not impair its hue. On the other hand, regarding black toners, colored charge control agents can also be used.

The positively chargeable charge control agent includes Nigrosine dyes, for example, "BONTRON N-01," "BONTRON N-04," "BONTRON N-07," hereinabove commercially available from Orient Chemical Industries Co., Ltd., "CHUO CCA-3" commercially available from CHUO GOUSEI KAGAKU CO., LTD., and the like; triphenylmethane-based dyes containing a tertiary amine as a side chain; quaternary ammonium salt compounds, for example, "BONTRON P-51" commercially available from Orient Chemical Industries Co., Ltd., "TP-415" commercially available from Hodogaya Chemical Co., Ltd., cetyltrimethylammonium bromide, "COPY CHARGE PX VP435" commercially available from Clariant Japan, Ltd.; and the like.

Among the above positively chargeable charge control agents, in the color toners, the quaternary ammonium salt compounds are preferred, from the viewpoint of not impairing its hue, and from the viewpoint of appropriately adjusting triboelectric charges of the toner, a quaternary ammonium compound represented by the formula (II):

(II)

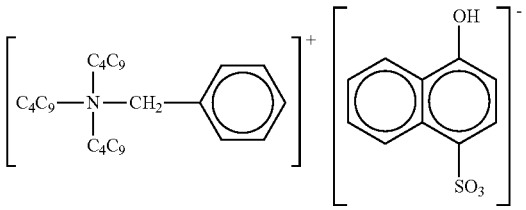

is more preferred. A commercially available product of the quaternary ammonium salt compound represented by the formula (II) is the above "BONTRON P-51."

On the other hand, as for the black toners, the Nigrosine dyes are preferred, from the viewpoint of appropriately adjusting triboelectric charges of the toner.

The Nigrosine dye is generally a black mixture composed of a large number of components obtained by polycondensation of nitrobenzene and aniline in the presence of a metal catalyst, and its structure is not fully elucidated. Commercially available nigrosine dyes, including modified products with a resin acid or the like, include, besides "BONTRON N-01," "BONTRON N-04" and "BONTRON N-07" mentioned above, "Nigrosine Base EX," "Oil Black BS," "Oil Black SO," "BONTRON N-09," "BONTRON N-11," "BONTRON N-21" hereinabove commercially available from Orient Chemical Industries Co., Ltd., "Nigrosine" commercially available from Ikeda Kagaku Kogyo, "Spirit Black No. 850," "Spirit Black No. 900" hereinabove commercially available from Sumitomo Chemical Co., Ltd., and the like.

The negatively chargeable charge control agent includes metal-containing azo dyes, for example, "BONTRON S-28" commercially available from Orient Chemical Industries Co., Ltd., "T-77" commercially available from Hodogaya Chemical Co., Ltd., "BONTRON S-34" commercially available from Orient Chemical Industries Co., Ltd., "AIZEN SPILON BLACK TRH" commercially available from Hodogaya Chemical Co., Ltd., and the like; copper phthalocyanine dyes; metal complexes of alkyl derivatives of salicylic acid, for example, "BONTRON E-81," "BONTRON E-84," "BONTRON E-304," hereinabove commercially available from Orient Chemical Industries Co., Ltd., and the like; nitroimidazole derivatives; boron complexes of benzilic acid, for example, "LR-147" commercially available from Japan Carlit, Ltd.; nonmetallic charge control agents, for example, "BONTRON F-21," "BONTRON E-89," hereinabove commercially available from Orient Chemical Industries Co., Ltd., "T-8" commercially available from Hodogaya Chemical Co., Ltd., and the like.

The content of the charge control agent in the toner is preferably from 0.5 to 8 parts by weight, and more preferably from 1 to 5 parts by weight, based on 100 parts by weight of the resin binder, from the viewpoint of improving low-temperature fixing ability of the toner, and appropriately adjusting triboelectric charges.

<Charge Control Resin>

It is preferable that the toner obtained by the method of the present invention further contains a charge control resin, from the viewpoint of reducing a pulverization pressure during pulverization and suppressing the amount of fine powders generated, thereby improving the pulverization and classification yield.

The charge control agent includes styrene-acrylic resins, polyamine resins, phenolic resins, and the like. Among them, the styrene-acrylic resins are preferred, from the viewpoint of reducing a pulverization pressure during pulverization and suppressing the amount of fine powders generated, thereby improving the pulverization and classification yield.

The styrene-acrylic resin is preferably a styrene-acrylic copolymer containing a quaternary ammonium salt group, and more preferably a styrene-acrylic copolymer containing a quaternary ammonium salt group obtained by polymerizing a mixture of a monomer represented by the formula (III):

(III)

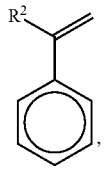

wherein $R^2$ is a hydrogen atom or a methyl group, a monomer represented by the formula (IV):

(IV)

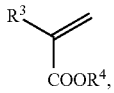

wherein $R^3$ is a hydrogen atom or a methyl group, and $R^4$ is an alkyl group having 1 to 6 carbon atoms, and a monomer represented by the formula (V):

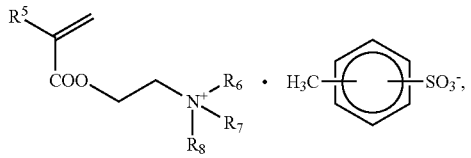

(V)

wherein $R^5$ is a hydrogen atom or a methyl group, and each of $R^6$, $R^7$, and $R^8$ is an alkyl group having 1 to 4 carbon atoms.

In the formula (III), it is preferable that $R^2$ is a hydrogen atom, from the viewpoint of improving triboelectric chargeability.

In the formula (IV), it is preferable that $R^3$ is a hydrogen atom, and that $R^4$ is a butyl group, from the viewpoint of improving triboelectric chargeability.

In the formula (V), it is preferable that $R^5$ is a methyl group, and that each of $R^6$, $R^7$ and $R^8$ is an ethyl group, from the viewpoint of improving triboelectric chargeability.

The content of the monomer represented by the formula (III) is preferably from 60 to 95% by weight, more preferably from 70 to 95% by weight, and even more preferably from 78 to 90% by weight, of the monomer mixture, from the viewpoint of improving low-temperature fixing ability and hygroscopic resistance of the toner, and from the viewpoint of reducing a pulverization pressure during pulverization and suppressing the amount of fine powders generated, thereby improving the pulverization and classification yield.

The content of the monomer represented by the formula (IV) is preferably from 2 to 30% by weight, more preferably from 5 to 20% by weight, and even more preferably from 10 to 15% by weight, of the monomer mixture, from the viewpoint of improving low-temperature fixing ability and hygroscopic resistance of the toner, and from the viewpoint of reducing a pulverization pressure during pulverization and suppressing the amount of fine powders generated, thereby improving the pulverization and classification yield.

The content of the monomer represented by the formula (V) is preferably from 3 to 35% by weight, more preferably from 5 to 30% by weight, and even more preferably from 10 to 25% by weight, of the monomer mixture, from the viewpoint of improving low-temperature fixing ability and hygroscopic resistance of the toner, and from the viewpoint of reducing a pulverization pressure during pulverization and suppressing the amount of fine powders generated, thereby improving the pulverization and classification yield.

The polymerization of the monomer mixture can be carried out by, for example, heating a monomer mixture to 50° to 100° C. in an inert gas atmosphere in the presence of a polymerization initiator such as azobisdimethylvaleronitrile. Here, the polymerization method may be any of solution polymerization, suspension polymerization, or bulk polymerization, and preferably solution polymerization.

The styrene-acrylic copolymer containing a quaternary ammonium salt group has a softening point of preferably 115° C. or higher, more preferably from 115° to 140° C., even more preferably from 117° to 140° C., and still even more preferably from 120° to 135° C., from the viewpoint of improving low-temperature fixing ability and high-temperature offset resistance of the toner.

The styrene-acrylic copolymer containing a quaternary ammonium salt group includes, for example, "FCA-201PS" commercially available from FUJIKURA KASEI CO., LTD.

Other styrene-acrylic resins include "FCA-1001NS" commercially available from FUJIKURA KASEI CO., LTD., which is a styrene-acrylic copolymer not containing a quaternary ammonium salt group, and the like. In addition, the polyamine resin includes "AFP-B" commercially available from Orient Chemical Industries Co., Ltd., and the like, and the phenolic resin includes "FCA-2521NJ," "FCA-2508N," hereinabove commercially available from FUJIKURA KASEI CO., LTD.

The content of the charge control resin is preferably 1 part by weight or more, more preferably 2 parts by weight or more, even more preferably 3 parts by weight or more, and still even more preferably 4 parts by weight or more, based on 100 parts by weight of the resin binder, from the viewpoint of suppressing the amount of fine powders generated, thereby improving the pulverization and classification yield, and from the viewpoint of improving high-temperature offset resistance and heat-resistant storage property of the toner. In addition, the content of the charge control resin is preferably 15 parts by weight or less, more preferably 12 parts by weight or less, even more preferably 10 parts by weight or less, and still even more preferably 8 parts by weight or less, based on 100 parts by weight of the resin binder, from the viewpoint of reducing a pulverization pressure during pulverization, and from the viewpoint of improving low-temperature fixing ability of the toner. From these viewpoints taken together, the content of the charge control resin is preferably from 1 to 15 parts by weight, more preferably from 2 to 12 parts by weight, even more preferably from 3 to 10 parts by weight, and still even more preferably from 4 to 8 parts by weight, based on 100 parts by weight of the resin binder.

The toner obtained by the method of the present invention may contain, in addition to the resin binder and the charge control agent, a colorant, a releasing agent and the like.

<Colorant>

In the present invention, as the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The toner of the present invention may be any of black toners and color toners. It is preferable that the carbon blacks are preferred, from the viewpoint of reducing a pulverization pressure during pulverization and suppressing the amount of fine powders generated, thereby improving the pulverization and classification yield. The content of the colorant in the toner is preferably from 1 to 20 parts by weight, more preferably from 2 to 10 parts by weight, and even more preferably from 3 to 8 parts by weight, based on 100 parts by weight of the resin binder, from the viewpoint of improving optical density of the toner and from the viewpoint of improving fixing ability.

<Releasing Agent>

The releasing agent includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof; ester waxes such as carnauba wax, montan wax, and sazole wax, deacidified waxes thereof, and fatty acid ester waxes; fatty acid amides, fatty acids, higher alcohols, metal salts of fatty acids, and the like. These releasing agents may be used alone or in a mixture of two or more kinds.

The releasing agent has a melting point of preferably from 60° to 160° C., and more preferably from 60° to 150° C., from the viewpoint of improving low-temperature fixing ability and high-temperature offset resistance of the toner.

The content of the releasing agent is preferably 10 parts by weight or less, more preferably 8 parts by weight or less, and even more preferably 7 parts by weight or less, based on 100 parts by weight of the resin binder, from the viewpoint of improving heat-resistant storage property of the toner. In addition, the content of the releasing agent is preferably 0.5 parts by weight or more, more preferably 1.0 part by weight or more, and even more preferably 1.5 parts by weight or more, based on 100 parts by weight of the resin binder, from the viewpoint of improving low-temperature fixing ability and high-temperature offset resistance of the toner. Therefore, from these viewpoints taken together, the content of the releasing agent is preferably from 0.5 to 10 parts by weight, more preferably from 1.0 to 8 parts by weight, and even more preferably from 1.5 to 7 parts by weight, based on 100 parts by weight of the resin binder. Alternatively, the content of the releasing agent is preferably 2.0 parts by weight or more, more preferably 2.5 parts by weight or more, and even more preferably 3.0 parts by weight or more, based on 100 parts by weight of the resin binder, from the viewpoint of enabling oil-less fusing of the toner. Therefore, from these viewpoints taken together, the content of the releasing agent is preferably from 2.0 to 10 parts by weight, more preferably from 2.5 to 8 parts by weight, and even more preferably from 3.0 to 7 parts by weight, based on 100 parts by weight of the resin binder.

<Other Components>

The toner obtained by the method of the present invention may further properly contain an additive such as a magnetic particulate, a fluidity improver, an electric conductivity modifier, an extender pigment, a reinforcing filler such as a fibrous material, an antioxidant, an anti-aging agent, or a cleanability improver in the toner particles.

<Method for Producing Toner>

The method for producing a toner of the present invention includes:

step 1: melt-kneading components containing a resin binder and a charge control agent to provide a melt-kneaded product; and step 2: pulverizing the melt-kneaded product, and classifying a pulverized product, from the viewpoint of fully exhibiting the effects of the present invention. Specifically, the toner particles can be produced by homogeneously mixing raw materials such as a resin binder, a colorant, a charge control agent and a releasing agent with a mixer such as a Henschel mixer, thereafter melt-kneading the mixture, cooling, pulverizing, and classifying the product.

The melt-kneading of the raw materials containing at least a resin binder and a charge control agent, in the step 1 can be carried out with a known kneader, such as a closed kneader, a single-screw or twin-screw extruder, or a continuous open-roller type kneader. Since the raw materials for the toner such as a charge control agent can be efficiently highly dispersed in the resin binder without repeats of kneading or without a dispersion aid, a continuous open-roller type kneader provided with feeding ports and a discharging port for a kneaded product along the shaft direction of the roller is preferably used.

It is preferable that the raw materials for a toner are previously homogeneously mixed with a Henschel mixer, a Super-Mixer or the like, and thereafter fed to an open-roller type kneader, and the raw materials may be fed from one feeding port, or dividedly fed to the kneader from plural feeding ports. It is preferable that the raw materials for the toner are fed to the kneader from one feeding port, from the viewpoint of easiness of operation and simplification of an apparatus.

The continuous open-roller type kneader refers to a kneader of which kneading member is an open type, not being tightly closed, and the kneading heat generated during the kneading can be easily dissipated. In addition, it is desired that the continuous open-roller type kneader is a kneader provided with at least two rollers. The continuous open-roller type kneader usable in the present invention is a kneader provided with two rollers having different peripheral speeds, in other words, two rollers of a high-rotation roller having a high peripheral speed and a low-rotation roller having a low peripheral speed. In the present invention, it is desired that the high-rotation roller is a heat roller, and the low-rotation roller is a cooling roller, from the viewpoint of improvement in dispersibility of the raw materials for a toner, such as a charge control agent, in the resin binder.

The temperature of the roller can be adjusted by, for example, a temperature of a heating medium passing through the inner portion of the roller, and each roller may be divided in two or more portions in the inner portion of the roller, each being communicated with heating media of different temperatures.

The temperature at the end part of the raw material supplying side of the high-rotation roller is preferably from 100° to 160° C., and the temperature at the end part of the raw material supplying side of the low-rotation roller is preferably from 35° to 100° C.

In the high-rotation roller, the difference between a setting temperature at the end part of the raw material supplying side and a setting temperature at the end part of the kneaded product discharging side is preferably from 20° to 60° C., more preferably from 20° to 50° C., and even more preferably from 30° to 50° C., from the viewpoint of prevention in detachment of the kneaded product from the roller. In the low-rotation roller, the difference between a setting temperature at the end part of the raw material supplying side and a setting temperature at the end part of the kneaded product discharging side is preferably from 0° to 50° C., more preferably from 0° to 40° C., and even more preferably from 0° to 20° C., from the viewpoint of improvement in dispersibility of the raw materials for a toner, such as a charge control agent, in the resin binder.

The peripheral speed of the high-rotation roller is preferably from 2 to 100 m/min, more preferably from 10 to 75 m/min, and even more preferably from 25 to 50 m/min. The peripheral speed of the low-rotation roller is preferably from 1 to 90 m/min, more preferably from 5 to 60 m/min, and even more preferably from 15 to 30 m/min. In addition, the ratio between the peripheral speeds of the two rollers, i.e., low-rotation roller/high-rotation roller, is preferably from 1/10 to 9/10, and more preferably from 3/10 to 8/10.

Structures, size, materials and the like of the roller are not particularly limited. Also, the surface of the roller may be any of smooth, wavy, rugged, or other surfaces. In order to increase kneading share, it is preferable that plural spiral ditches are engraved on the surface of each roller.

The pulverization of the melt-kneaded product in the step 2 may be carried out in divided multi-stages. For example, the melt-kneaded product may be roughly pulverized to a size of from 1 to 5 mm or so, and the roughly pulverized product may then be further finely pulverized to a desired particle size.

The pulverizer usable in the pulverizing step is not particularly limited. For example, the pulverizer used preferably in the rough pulverization includes a hammer-mill, an atomizer, Rotoplex, and the like, and the pulverizer used preferably in the fine pulverization includes an impact type jet mill, a fluidised bed jet mill, a rotary mechanical mill, and the like. It is desired to use an impact-type jet mill, from the viewpoint of suppressing excessive pulverization of the melt-kneaded product.

The classifier usable in the classifying step includes an air classifier, a rotor type classifier, a sieve classifier, and the like. The pulverized product which is insufficiently pulverized and removed during the classifying step may be subjected to the pulverizing step again.

<External Additive Treatment Step>

It is preferable that the method for producing a toner of the present invention further includes, subsequent to the pulverizing and classifying step, the step of mixing the toner particles obtained, in other words, toner matrix particles, with an external additive.

The external additive includes, for example, fine inorganic particles of silica, alumina, titania, zirconia, tin oxide, zinc oxide, and the like, and fine organic particles such as fine melamine resin particles and fine polytetrafluoroethylene resin particles. Among them, it is preferable to use silicas in combination, and it is even more preferable to use together a silica having an average particle size of less than 20 nm and a silica having an average particle size of 20 nm or more at a weight ratio of from 90/10 to 10/90.

In the mixing of the toner matrix particles with an external additive, a mixer having an agitating member such as rotary blades is preferably used, more preferably a High-Speed Mixer such as a Henschel mixer or Super Mixer, and even more preferably a Henschel mixer.

<Volume-Median Particle Size of Toner>

The toner has a volume-median particle size $D_{50}$ of preferably from 3 to 15 μm, more preferably from 4 to 12 μl, and even more preferably from 6 to 9 μm, from the viewpoint of improving the image quality of the toner. The term "volume-median particle size $D_{50}$" as used herein means a particle size of which cumulative volume frequency calculated on a volume percentage is 50% counted from the smaller particle sizes. Also, in a case where the toner is treated with an external additive, the volume-median particle size is regarded as a volume-median particle size of the toner matrix particles.

The toner obtained by the method of the present invention can be used as a toner directly for monocomponent development, or as a toner mixed with a carrier for two-component development, in an apparatus for forming fixed images of a monocomponent development or a two-component development.

Regarding the embodiments mentioned above, the present invention will further disclose the following toner for electrostatic image development and the method for producing a toner for electrostatic image development.

<1> A toner for electrostatic image development containing at least a resin binder and a charge control agent, wherein the above resin binder contains a polyester A obtained by polycondensing an alcohol component containing 1,2-propanediol and a carboxylic acid component comprising a rosin compound and an aliphatic dicarboxylic acid compound having 6 to 10 carbon atoms, wherein 1,2-propanediol is contained in the alcohol component of the polyester A in an amount of 85% by mol or more.

<2> The toner for electrostatic image development according to the above <1>, wherein the resin binder contains a polyester H having a softening point of from 125° to 155° C., and preferably from 130° to 150° C., and a polyester L having a softening point of from 90° to 125° C., and preferably from 90° to 110° C., wherein a difference in softening points of the polyester H and the polyester L is 10° C. or more, preferably from 20° to 60° C., and more preferably from 30° to 50° C., and wherein at least one of the polyester H and the polyester L is the polyester A.

<3> The toner for electrostatic image development according to the above <2>, wherein the polyester H is the polyester A.

<4> The toner for electrostatic image development according to the above <2> or <3>, wherein the polyester L is a polyester B obtained by polycondensing an alcohol component containing 1,2-propanediol and a carboxylic acid component containing a rosin compound and but not containing an aliphatic dicarboxylic acid compound having 6 to 10 carbon atoms.

<5> The toner for electrostatic image development according to the above <4>, wherein a total content of the polyester A and the polyester B is 80% by weight or more, preferably 90% by weight or more, more preferably 95% by weight or more, and even more preferably substantially 100% by weight, of the resin binder.

<6> The toner for electrostatic image development according to any one of the above <1> to <5>, wherein the content of the rosin compound is 2.0% by mol or more, preferably 2.5% by mol or more, and more preferably 3.0% by mol or more, and 30% by mol or less, preferably 25% by mol or less, more preferably 15% by mol or less, and even more preferably 7% by mol or less, of the carboxylic acid component of the polyester A.

<7> The toner for electrostatic image development according to any one of the above <1> to <6>, wherein the content of the rosin compound is 2.0% by mol or more, preferably 2.5% by mol or more, and more preferably 3.0% by mol or more, and 25% by mol or less, preferably 20% by mol or less, more preferably 15% by mol or less, even more preferably 10% by mol or less, and still even more preferably 7% by mol or less, of the carboxylic acid component of all the polyesters contained in the resin binder.

<8> The toner for electrostatic image development according to any one of the above <4> to <7>, wherein the content of the rosin compound is 2.0% by mol or more, preferably 2.5% by mol or more, and more preferably 3.0% by mol or more, and 30% by mol or less, preferably 25% by mol or less, more preferably 15% by mol or less, and even more preferably 7% by mol or less, of the carboxylic acid component of the polyester B.

<9> The toner for electrostatic image development according to any one of the above <1> to <8>, wherein the content of the aliphatic dicarboxylic acid compound having 6 to 10 carbon atoms is 0.5% by mol or more, preferably 1.5% by mol or more, more preferably 2.0% by mol or more, and even more preferably 2.5% by mol or more, and 8% by mol or less, preferably 6% by mol or less, more preferably 4.5% by mol or less, and even more preferably 3.5% by mol or less, of the carboxylic acid component of all the polyesters contained in the resin binder.

<10> The toner for electrostatic image development according to any one of the above <1> to <9>, wherein the content of the aliphatic dicarboxylic acid compound having 6 to 10 carbon atoms is 0.5% by mol or more, preferably 1.5% by mol or more, more preferably 2.0% by mol or more, and even more preferably 3.0% by mol or more, and 9% by mol or less, preferably 7% by mol or less, more preferably 5.5% by mol or less, and even more preferably 4.5% by mol or less, of the carboxylic acid component of the polyester A.

<11> The toner for electrostatic image development according to any one of the above <1> to <10>, wherein the aliphatic dicarboxylic acid compound having 6 to 10 carbon atoms is one or more members selected from the group consisting of sebacic acid compounds and adipic acid compounds, preferably one or more members selected from the group consisting of sebacic acid and adipic acid, and more preferably sebacic acid.

<12> The toner for electrostatic image development according to any one of the above <1> to <11>, wherein the content of 1,2-propanediol is 85% by mol or more, preferably 90% by mol or more, more preferably 95% by mol or more, and even more preferably substantially 100% by mol, of the alcohol component of the polyester A.

<13> The toner for electrostatic image development according to any one of the above <1> to <12>, wherein the content of 1,2-propanediol is 85% by mol or more, preferably 90% by mol or more, more preferably 95% by mol or more, and even more preferably substantially 100% by mol, of the alcohol component of all the polyesters contained in the resin binder.

<14> The toner for electrostatic image development according to any one of the above <4> to <13>, wherein the content of 1,2-propanediol is 85% by mol or more, preferably 90% by mol or more, more preferably 95% by mol or more, and even more preferably substantially 100% by mol, of the alcohol component of the polyester B.

<15> The toner for electrostatic image development according to any one of the above <1> to <14>, wherein the rosin compound in the carboxylic acid component of the polyester A is an unmodified rosin compound.

<16> The toner for electrostatic image development according to any one of the above <1> to <15>, wherein the rosin compound in the carboxylic acid component of the polyester A has a softening point of from 50° to 100° C., preferably from 60° to 90° C., and more preferably from 65° to 85° C.

<17> The toner for electrostatic image development according to any one of the above <1> to <16>, wherein the rosin compound in the carboxylic acid component of the polyester A has an acid value of from 100 to 200 mg KOH/g, preferably from 130 to 180 mg KOH/g, and more preferably from 150 to 170 mg KOH/g.

<18> The toner for electrostatic image development according to any one of the above <4> to <17>, wherein the rosin compound in the carboxylic acid component of the polyester B is an unmodified rosin compound.

<19> The toner for electrostatic image development according to any one of the above <4> to <18>, wherein the rosin compound in the carboxylic acid component of the polyester B has a softening point of from 50° to 100° C., preferably from 60° to 90° C., and more preferably from 65° to 85° C.

<20> The toner for electrostatic image development according to any one of the above <4> to <19>, wherein the rosin compound in the carboxylic acid component of the polyester B has an acid value of from 100 to 200 mg KOH/g, preferably from 130 to 180 mg KOH/g, and more preferably from 150 to 170 mg KOH/g.

<21> The toner for electrostatic image development according to any one of the above <4> to <20>, wherein the polyester A and the polyester B are in a weight ratio, i.e. polyester A/polyester B, of from 30/70 to 95/5, preferably from 40/60 to 90/10, more preferably from 45/55 to 90/10, even more preferably from 50/50 to 85/15, still even more preferably from 50/50 to 80/20, and still even more preferably from 55/45 to 80/20.

<22> The toner for electrostatic image development according to any one of the above <1> to <21>, wherein the content of the polyester A is from 30 to 95% by weight, preferably from 40 to 90% by weight, more preferably from 45 to 90% by weight, even more preferably from 50 to 85% by weight, still even more preferably from 50 to 80% by weight, and still even more preferably from 55 to 80% by weight, of the resin binder.

<23> The toner for electrostatic image development according to any one of the above <4> to <22>, wherein the content of the polyester B is from 5 to 70% by weight, preferably from 10 to 60% by weight, more preferably from 10 to 55% by weight, even more preferably from 15 to 50% by weight, still even more preferably from 20 to 50% by weight, and still even more preferably from 20 to 45% by weight, of the resin binder.

<24> The toner for electrostatic image development according to any one of the above <1> to <23>, wherein the polyester A has a softening point of preferably from 90° to 155° C.

<25> The toner for electrostatic image development according to any one of the above <1> to <24>, wherein the polyester A has a glass transition temperature of from 50° to 80° C., and preferably from 55° to 70° C.

<26> The toner for electrostatic image development according to any one of the above <4> to <25>, wherein the polyester B has a softening point of from 90° to 155° C., and preferably from 90° to 110° C.

<27> The toner for electrostatic image development according to any one of the above <4> to <26>, wherein the polyester B has a glass transition temperature of from 50° to 80° C., and preferably from 55° to 65° C.

<28> The toner for electrostatic image development according to any one of the above <1> to <27>, wherein the charge control agent contains a charge control resin.

<29> The toner for electrostatic image development according to the above <28>, wherein the content of the charge control resin is 1 part by weight or more, preferably 2 parts by weight or more, more preferably 3 parts by weight or more, and even more preferably 4 parts by weight or more, and 15 parts by weight or less, preferably 12 parts by weight or less, more preferably 10 parts by weight or less, and even more preferably 8 parts by weight or less, based on 100 parts by weight of the resin binder.

<30> The toner for electrostatic image development according to the above <28> or <29>, wherein the charge control resin is a styrene-acrylic copolymer containing a quaternary ammonium salt group.

<31> The toner for electrostatic image development according to the above <30>, wherein the styrene-acrylic copolymer containing a quaternary ammonium salt group is a styrene-acrylic copolymer containing a quaternary ammonium salt group obtained by polymerizing a mixture of a monomer represented by the formula (III), a monomer represented by the formula (IV), and a monomer represented by the formula (V).

<32> A method for producing the toner for electrostatic image development as defined in any one of the above <1> to <31> containing at least a resin binder and a charge control agent, including:

step 1: melt-kneading components containing a resin binder and a charge control agent to provide a melt-kneaded product; and step 2: pulverizing the melt-kneaded product, and classifying a pulverized product, wherein the resin binder contains a polyester A obtained by polycondensing an alcohol component containing 1,2-propanediol and a carboxylic acid component containing a rosin compound and an aliphatic dicarboxylic acid compound having 6 to 10 carbon atoms, wherein 1,2-propanediol is contained in the alcohol component of the polyester A in an amount of 85% by mol or more.

<33> The method for producing a toner for electrostatic image development according to the above <32>, wherein the step 1 includes melt-kneading the components with a continuous open-roller type kneader.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which half of the sample flows out, when plotting a downward movement of a plunger of a flow tester commercially available from Shimadzu Corporation, CAPILLARY RHEOMETER "CFT-500D", against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Glass Transition Temperature of Resin]

Measurements were taken using a differential scanning calorimeter "Q-100," commercially available from TA Instruments, Japan, by heating a 0.01 to 0.02 g sample weighed out in an aluminum pan to 200° C. and cooling the sample from that temperature to 0° C. at a cooling rate of 10° C./min. Next, the sample was measured while heating at a rate of 10° C./min. A temperature of an intersection of the extension of the baseline of equal to or lower than the temperature of maximum endothermic peak and the tangential line showing the maximum inclination between the kick-off of the peak and the top of the peak in the above measurement is defined as a glass transition temperature.

[Acid Value of Resin and Rosin Compound]

The acid value is determined by a method according to JIS K0070 except that only the determination solvent is changed from a mixed solvent of ethanol and ether as defined in JIS K0070 to a mixed solvent of acetone and toluene in a volume ratio of acetone:toluene=1:1.

[Softening Point of Rosin Compound]

(1) Preparation of Samples

Ten grams of a rosin is melted with a hot plate at 170° C. for 2 hours. Thereafter, the molten rosin is air-cooled in an open state in the environmental conditions of a temperature of 25° C. and relative humidity of 50% for 1 hour, and pulverized with a coffee-mill "National Panasonic MK-61M" for 10 seconds.

(2) Measurement

The softening point refers to a temperature at which half of the sample flows out, when plotting a downward movement of a plunger of a flow tester commercially available from Shimadzu Corporation, CAPILLARY RHEOMETER "CFT-500D", against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Flash Point of Rosin Compound]

The flash point is determined according to Cleveland Open type Flash Point Test, which is a method as prescribed in JIS K2265.

[Melting Point of Releasing Agent]

A temperature of maximum endothermic peak observed from endothermic curve of the heat of fusion obtained by raising the temperature of a sample to 200° C. at a heating rate of 10° C./min, cooling the sample from this temperature to −10° C. at a cooling rate of 10° C./min, and thereafter raising the temperature of the sample to 180° C. at a heating rate of 10° C./min, using a differential scanning calorimeter "DSC Q-20," commercially available from TA Instruments, Japan, is referred to as a melting point.

[Average Particle Size of External Additive]

Particle sizes were determined for 500 particles from a photograph taken with a scanning electron microscope, SEM, an average of length and breadth of the particles of which is taken, and the average is referred to as an average particle size.

[Volume-Median Particle Size $D_{50}$ of Toner]

Measuring Apparatus Coulter Multisizer II commercially available from Beckman Coulter, Inc.

Aperture Diameter: 100 μm

Analyzing Software: Coulter Multisizer AccuComp Ver. 1.19 commercially available from Beckman Coulter, Inc.

Electrolytic solution: "Isotone II" commercially available from Beckman Coulter, Inc.

Dispersion: "EMULGEN 109P" commercially available from Kao Corporation, polyoxyethylene lauryl ether, HLB: 13.6 is dissolved in the above electrolytic solution so as to have a concentration of 5% by weight to provide a dispersion.

Dispersion Conditions Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

Production Example 1 of Rosin

Rosin Compound 2

A rosin compound 1, unpurified tall oil rosin, commercially available from Harima Kasei under HARTALL R-WW, having a softening point of 73° C., an acid value of 169 mg KOH/g, and a flash point of 198° C., to prepare a rosin compound 2.

Specifically, a 2,000-ml distillation flask equipped with a fractionation tube, a reflux condenser and a receiver was charged with 1,000 g of the rosin compound 1, and rosin compound 1 was distilled under a reduced pressure of 13.3 kPa, and a fractionation component at 195° to 250° C. was collected as a main fractionation component to provide a rosin compound 2. The rosin compound 2 had a softening point of 75° C., an acid value of 166 mg KOH/g, and a flash point of 199° C.

Twenty grams of the rosin compound 2 was pulverized with a coffee mill, commercially available from National Panasonic MK-61M, for 5 seconds, and the rosin having sizes of 1-mm sieve opening-passed were measured off in an amount of 0.5 g in a 20-ml vial for headspace. A headspace gas was sampled, and the results of analyzing impurities in the rosin compound 2 according to headspace GC-MS method are shown in Table 1 together with those in the rosin compound 1.

Measurement Conditions for Headspace GC-MS Method

A. Headspace Sampler commercially available from Agilent, "HP7694"

Sample Temperature: 200° C.;

Loop Temperature: 200° C.;

Transfer Line Temperature: 200° C.;

Equilibrating Time for Sample Heating: 30 min.;

Vial Pressure Gas: Helium;

Vial Pressing Time: 0.3 min.;

Loop Filling Time: 0.03 min.;

Loop Equilibrating Time: 0.3 min.; and

Injection Time: 1 min.

B. GC (Gas Chromatography), commercially available from Agilent, "HP6890"

Analyzing Column: DB-1: 60 $m^{-320}$ μm-5 μm;

Carrier: Helium;

Flow Rate Conditions: 1 ml/min.;

Injection Inlet Temperature: 210° C.;

Column Head Pressure: 34.2 kPa;

Injection Mode: split;

Split Ratio: 10:1; and

Oven Temperature Conditions: 45° C., 3 min.-10° C./min.-280° C., 15 min.

C. MS (Mass Spectroscopy), commercially available from Agilent, "HP5973"

Ionization Method: EI (Electron Ionization) method;

Interface Temperature: 280° C.;

Ion Source Temperature: 230° C.;

Quadrupole Temperature: 150° C.; and

Detection Mode: Scan 29-350 m/s.

TABLE 1

| Impurities | Hexanoic Acid | Pentanoic Acid | Benzal-dehyde | n-Hexanal | 2-Pentylfuran |
|---|---|---|---|---|---|
| Rosin Compound 1 | $0.9 \times 10^7$ | $0.7 \times 10^7$ | $0.6 \times 10^7$ | $1.8 \times 10^7$ | $1.1 \times 10^7$ |

TABLE 1-continued

| Impurities | Hexanoic Acid | Pentanoic Acid | Benzal-dehyde | n-Hexanal | 2-Pentylfuran |
|---|---|---|---|---|---|
| Rosin Compound 2 | $0.4 \times 10^7$ | $0.2 \times 10^7$ | $0.2 \times 10^7$ | $1.5 \times 10^7$ | $0.6 \times 10^7$ |

Note)
Numerical values show peak intensities in the GC-MS measurement.

Production Example 1 of Resins

Resins A to T

A 5-liter four-neck flask equipped with a nitrogen inlet tube, dehydration tube equipped with a fractional distillation tube through which hot water at 98° C. was allowed to flow, a stirrer, and a thermocouple was charged with raw material monomers other than trimellitic anhydride and an esterification catalyst, as listed in Table 2 or 3, and the temperature was raised from room temperature to 180° C. over about 2 hours in a nitrogen atmosphere, and thereafter raised from 180° to 210° C. at a rate of 10° C./hr, and the heated contents were reacted at 210° C. until a reaction percentage reached 90%. Thereafter, the pressure was recovered to a normal pressure, and trimellitic anhydride was added thereto, the reaction was carried out at 210° C. and normal pressure for 1 hour, and the reaction was then carried out at 20 kPa until a desired softening point was reached, to provide each of the resins A to T. The physical properties of the resins A to T are shown in Tables 2 and 3. Here, the reaction percentage refers to a value calculated by [amount of water generated/theoretical amount of water generated]×100.

TABLE 2

| | Resin A | Resin B | Resin C | Resin D | Resin E | Resin F | Resin G | Resin H | Resin I | Resin J |
|---|---|---|---|---|---|---|---|---|---|---|
| Raw Material Monomers | | | | | | | | | | |
| 1,2-Propanediol (1,2-PD) | 1522 g (100) | 1522 g (100) | 1522 g (100) | 1522 g (100) | 1522 g (100) | 1522 g (100) | 1522 g (100) | 1522 g (100) | 1522 g (100) | 1522 g (100) |
| Terephthalic Acid | 2077 g (62.5) | 2093 g (63) | 2027 g (61) | 2127 g (64) | 1994 g (60) | 2492 g (75) | 2077 g (62.5) | 2077 g (62.5) | 2077 g (62.5) | 2077 g (62.5) |
| Trimellitic Anhydride | 384 g (10) | 384 g (10) | 384 g (10) | 384 g (10) | 384 g (10) | 115 g (3) | 384 g (10) | 384 g (10) | 384 g (10) | 384 g (10) |
| Rosin Compound 1 | 202 g (3) | 202 g (3) | 202 g (3) | 202 g (3) | 202 g (3) | 202 g (3) | 202 g (3) | 202 g (3) | 202 g (3) | — |
| Rosin Compound 2 | — | — | — | — | — | — | — | — | — | 202 g (3) |
| Sebacic Acid | 113 g (2.8) | 81 g (2) | 162 g (4) | 40 g (1) | 202 g (5) | 113 g (2.8) | — | 113 g (2.8) | 113 g (2.8) | 113 g (2.8) |
| Adipic Acid | — | — | — | — | — | — | 82 g (2.8) | — | — | — |
| Ratio of Raw Materials | | | | | | | | | | |
| Content of 1,2-PD (% by mol) in Alcohol Component | 100 | 100 | 100 | 100 | 100 | 100 | 100 | 100 | 100 | 100 |
| Content of Rosin Compound (% by mol) in Carboxylic Acid Component | 3.8 | 3.8 | 3.8 | 3.8 | 3.8 | 3.6 | 3.8 | 3.8 | 3.8 | 3.8 |
| Content of Aliphatic Dicarboxylic Acid Compound Having 6 to 10 Carbon Atoms (% by mol) in Carboxylic Acid Component | 3.6 | 2.6 | 5.1 | 1.3 | 6.4 | 3.3 | 3.6 | 3.6 | 3.6 | 3.6 |
| Esterification Catalyst | | | | | | | | | | |
| Dibutyltin Oxide | 9 g | 9 g | 9 g | 9 g | 9 g | 9 g | 9 g | 9 g | 9 g | 9 g |
| Physical Properties of Resins | | | | | | | | | | |
| Softening Point (° C.) | 142 | 142 | 142 | 143 | 141 | 101 | 143 | 133 | 148 | 142 |
| Glass Transition Temperature (° C.) | 64 | 65 | 62 | 67 | 61 | 57 | 66 | 64 | 65 | 64 |
| Acid Value (mg KOH/g) | 17.1 | 14.2 | 14.5 | 13.3 | 16.9 | 3.4 | 16.2 | 6.3 | 3.7 | 17.6 |

Note)
The numerical values inside parentheses are expressed as % by mol, supposing that a total amount of the alcohol component is regarded as 100% by mol.

TABLE 3

| | Resin K | Resin L | Resin M | Resin N | Resin O | Resin P | Resin Q | Resin R | Resin S | Resin T |
|---|---|---|---|---|---|---|---|---|---|---|
| Raw Material Monomers | | | | | | | | | | |
| 1,2-Propanediol (1,2-PD) | 1522 g (100) | 1522 g (100) | 1522 g (100) | 1522 g (100) | 1522 g (100) | 1522 g (100) | 1522 g (100) | 1522 g (100) | 1217 g (80) | 1217 g (80) |
| Ethylene Glycol | — | — | — | — | — | — | — | — | 248 g (20) | 248 g (20) |
| Terephthalic Acid | 1794 g (54) | 2492 g (75) | 2492 g (75) | 2160 g (65) | 2492 g (75) | 2492 g (75) | 2127 g (64) | 2542 g (76.5) | 2077 g (62.5) | 2492 g (75) |
| Trimellitic Anhydride | 384 g (10) | 115 g (3) | 115 g (3) | 384 g (10) | 115 g (3) | 115 g (3) | 384 g (10) | 115 g (3) | 384 g (10) | 115 g (3) |
| Rosin Compound 1 | 1344 g (20) | — | 202 g (3) | 202 g (3) | 202 g (3) | 202 g (3) | — | — | 202 g (3) | 202 g (3) |
| Rosin Compound 2 | — | 202 g (3) | — | — | — | — | — | — | — | — |
| Sebacic Acid | 113 g (2.8) | — | — | — | — | — | 101 g (2.5) | — | 101 g (2.5) | — |
| Ratio of Raw Materials | | | | | | | | | | |
| Content of 1,2-PD (% by mol) in Alcohol Component | 100 | 100 | 100 | 100 | 100 | 100 | 100 | 100 | 80 | 80 |
| Content of Rosin Compound (% by mol) in Carboxylic Acid Component | 23.0 | 3.7 | 3.7 | 3.8 | 3.7 | 3.7 | 0 | 0 | 3.8 | 3.7 |
| Content of Aliphatic Dicarboxylic Acid Compound Having 6 to 10 Carbon Atoms (% by mol) in Carboxylic Acid Component | 3.2 | 0 | 0 | 0 | 0 | 0 | 3.3 | 0 | 3.2 | 0 |
| Esterification Catalyst | | | | | | | | | | |
| Dibutyltin Oxide | 9 g | 9 g | 9 g | 9 g | 9 g | 9 g | 9 g | 9 g | 9 g | 9 g |
| Physical Properties of Resins | | | | | | | | | | |
| Softening Point (° C.) | 145 | 100 | 101 | 143 | 95 | 104 | 142 | 101 | 142 | 101 |
| Glass Transition Temperature (° C.) | 63 | 60 | 60 | 68 | 59 | 61 | 63 | 60 | 65 | 62 |
| Acid Value (mg KOH/g) | 18.1 | 5.6 | 4.2 | 11.1 | 21.3 | 13.8 | 15.2 | 4.4 | 15.1 | 3.9 |

Note)
The numerical values inside parentheses are expressed as % by mol, supposing that a total amount of the alcohol component is regarded as 100% by mol.

Production Examples of Toners

Examples 1 to 18 and Comparative Examples 1 to 3

One-hundred parts by weight of a resin binder in a given amount listed in Table 4, 4.0 parts by weight of a colorant "ECB-301" commercially available from DAINICHISEIKA COLOR & CHEMICALS MFG. CO., LTD., phthalocyanine blue, P.B. 15:3, 2.0 parts by weight of a positively chargeable charge control agent "BONTRON P-51" commercially available from Orient Chemical Industries Co., Ltd., 2.0 parts by weight of a releasing agent "Mitsui Hi-Wax" commercially available from MITSUI CHEMICALS, INC., melting point 140° C., and 1.0 part by weight of a releasing agent "Sazole Wax SP105" commercially available from S. Kato & CO., melting point: 117° C. were mixed with a Henschel mixer for 1 minute, and the mixture was then melt-kneaded under the following conditions.

A continuous twin open-roller type kneader "Kneadex" commercially available from MITSUI MINING COMPANY, LIMITED, outer diameter of roller: 14 cm, effective length of roller: 80 cm, was used. The operating conditions of the continuous twin open-roller type kneader are a peripheral speed of a high-rotation roller, which is a front roller, of 32.4 m/min, a peripheral speed of a low-rotation roller, which is a back roller, of 21.7 m/min, and a gap between the rollers of 0.1 mm. The temperatures of the heating medium and the cooling medium inside the rollers are as follows. The high-rotation roller had a temperature at the raw material supplying side of 135° C., and a temperature at the kneaded product discharging side of 90° C., and the low-rotation roller has a temperature at the raw material supplying side of 35° C., and a temperature at the kneaded product discharging side of 35° C. In addition, the feeding rate of the raw material mixture was 4 kg/hour, and the average residence time was about 6 minutes.

After cooling the melt-kneaded product, and the melt-kneaded product was roughly pulverized to a size of 1 mm or so with a hammer-mill commercially available from Hosokawa Micron Corporation. Thereafter, the roughly pulverized product obtained was pulverized with an impact-type jet mill pulverizer IDS-2 commercially available from Nippon Pneumatic Mfg. Co., Ltd. at a supplying rate of 4.0 kg/hr, while adjusting a pulverization pressure so as to have a volume-median particle size $D_{50}$ after the fine pulverization of 6.5 μm. In addition, a 1 g sample after the fine pulverization was taken, and the amount of fine powders having sizes of 3 μm % by number or less was measured in accordance with a test method described below.

Thereafter, the finely pulverized product was classified with a classifier Model DSX2, commercially available from Nippon Pneumatic Mfg. Co., Ltd., to provide toner matrix particles having a volume-median particle size $D_{50}$ of 7.0 μm. The pulverization and classification yield was calculated from the roughly pulverized product supplied and the amount of toner obtained after the pulverization and classification. The results of the pulverization pressure, the amount of fine powders having sizes of 3 μm % by number or less, and the pulverization and classification yield are shown in Table 4.

One hundred parts by weight of the toner matrix particles obtained were mixed with 0.5 parts by weight of a hydrophobic silica "TG-820F" commercially available from Cabot Specialty Chemicals Inc, average particle size: 8 nm and 1.0 part by weight of a hydrophobic silica "NA50H" commercially available from Nihon Aerosil Co., Ltd., average particle size: 40 nm with a Henschel mixer commercially available from MITSUI MINING COMPANY, LIMITED at 2,100 r/min, i.e. a peripheral speed of 29 m/sec, for 3 minutes, to provide each of the toners.

Test Example 1

Measurement of Content of Particles Having Particle Sizes of 3 μm or Less

The content of the particles having particle sizes of 3 μm or less of the finely pulverized product before classification, in terms of % by number, was measured by the following method.

Measuring Apparatus Coulter Multisizer III commercially available from Beckman Coulter, Inc.

Aperture Diameter: 100 μm

Analyzing Software: Coulter Multisizer AccuComp Ver. 1.19 commercially available from Beckman Coulter, Inc.

Electrolytic solution: "Isotone II" commercially available from Beckman Coulter, Inc.

Dispersion: "EMULGEN 109P" commercially available from Kao Corporation, polyoxyethylene lauryl ether, HLB: 13.6 is dissolved in the above electrolytic solution so as to have a concentration of 5% by weight to provide a dispersion.

Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a content of the particles having particle sizes of 3 μm or less as expressed in units of % by number is obtained from the particle size distribution. The smaller the numerical value, the more favorable.

Test Example 2

Low-Temperature Fixing Ability

A toner was loaded to a printer "HL-2040" commercially available from Brother Industries, modified so as to obtain an unfixed image, and an unfixed image which was a solid image of a square having a side of 2 cm was printed. Thereafter, this unfixed image was subjected to a fixing treatment at each temperature with an external fixing device, an modified device of an oilless fixing system "DL-2300" commercially available from Konica Minolta, a device in which a fixing roller was set at a rotational speed of 265 mm/sec, and a fixing roller temperature in the fixing device was made variable, while raising the fixing roller temperatures from 100° to 230° C. in an increment of 5° C., to provide fixed images. A sand-rubber eraser to which a load of 500 g was applied was moved backward and forward five times over a fixed image obtained at each fixing temperature. The temperature of the fixing roller at which a ratio of image densities before and after rubbing, i.e. image densities after rubbing/before rubbing×100, initially exceeds 90% is defined as a lowest fixing temperature, which was used as an index for low-temperature fixing ability. The lower the lowest fixing temperature, the more excellent the low-temperature fixing ability. The results are shown in Table 4.

Test Example 3

High-Temperature Offset Resistance

A toner was loaded to a printer "HL-2040" commercially available from Brother Industries, modified so as to obtain an unfixed image, and an unfixed image which was a solid image of a square having a side of 2 cm was printed. Thereafter, this unfixed image was subjected to a fixing treatment at each temperature with an external fixing device, an modified device of an oilless fixing system "DL-2300" commercially available from Konica Minolta, a device in which a fixing roller was set at a rotational speed of 140 mm/sec, and a fixing roller temperature in the fixing device was made variable, while raising the fixing roller temperatures from the above-mentioned lowest fixing temperature to 230° C. in an increment of 5° C. A temperature at which staining of the fixing roller is generated, leading to the generation of stains on white paper portions of the printout is defined as a high-temperature offset generating temperature, which was used as an index for high-temperature offset resistance. The higher the high-temperature offset generating temperature, the more excellent the high-temperature offset resistance. The results are shown in Table 4.

Test Example 4

Heat-Resistant Storage Property

A 20-ml polypropylene bottle was charged with 4 g of a toner. The toner-containing polypropylene bottle was placed in a thermohygrostat kept at 55° C. and a relative humidity of 80%, and the toner was stored for 48 hours in an open state without placing a lid of the polypropylene bottle. The degree of aggregation of the toner after storage was measured, which was used as an index for heat-resistant storage property. The smaller this numerical value, the more excellent the heat-resistant storage property. The results are shown in Table 4.

Degree of Aggregation

The degree of aggregation is measured with a powder tester commercially available from Hosokawa Micron Corporation.

Sieves having opening of 150 μm, 75 μm, and 45 μm are stacked on top of each other, 4 g of a toner is placed on the uppermost sieve, and the sieves are vibrated at an oscillation width of 1 mm for 60 seconds. After the vibration, an amount of the toner remaining on the sieve is measured, and the degree of aggregation is calculated using the following sets of formulas:

$$\text{Degree of Aggregation} = a + b + c, \text{ wherein}$$

$$a = \frac{\text{Mass of Toner Remaining on Top Sieve}}{\text{Amount of Sample}} \times 100$$

$$b = \frac{\text{Mass of Toner Remaining on Middle Sieve}}{\text{Amount of Sample}} \times 100 \times \frac{3}{5}$$

$$c = \frac{\text{Mass of Toner Remaining on Lower Sieve}}{\text{Amount of Sample}} \times 100 \times \frac{1}{5}$$

TABLE 4

| | Resin Binder | | | | | | Content of Particles | | Low-Temp. | High-Temp. | Heat-Resistant |
|---|---|---|---|---|---|---|---|---|---|---|---|
| | Polyester H (Parts by Weight) | Polyester L (Parts by Weight) | X | Y | Z | Pulverization Pressure (MPa) | Having Sizes of 3 μm or Less (% by number) | Yield (%) | Fixing Ability (° C.) | Offset Resistance (° C.) | Storage Property (%) |
| Ex. 1 | Resin A (75) | Resin M (25) | 100 | 3.8 | 2.7 | 0.35 | 9.3 | 66.6 | 155 | 190 | 14.6 |
| Ex. 2 | Resin B (75) | Resin M (25) | 100 | 3.8 | 1.9 | 0.32 | 9.1 | 65.0 | 155 | 185 | 10.3 |
| Ex. 3 | Resin C (75) | Resin M (25) | 100 | 3.8 | 3.8 | 0.38 | 8.5 | 69.2 | 150 | 190 | 18.9 |
| Ex. 4 | Resin D (75) | Resin M (25) | 100 | 3.8 | 1.0 | 0.31 | 9.0 | 67.1 | 165 | 180 | 7.8 |
| Ex. 5 | Resin E (75) | Resin M (25) | 100 | 3.8 | 4.8 | 0.38 | 7.3 | 71.1 | 150 | 200 | 49.3 |
| Ex. 6 | Resin A (100) | | 100 | 3.8 | 3.6 | 0.37 | 6.4 | 75.5 | 165 | 200 | 3.9 |
| Ex. 7 | Resin A (90) | Resin M (10) | 100 | 3.8 | 3.2 | 0.35 | 7.9 | 72.8 | 160 | 200 | 7.8 |
| Ex. 8 | Resin A (60) | Resin M (40) | 100 | 3.8 | 2.1 | 0.33 | 10.8 | 63.3 | 155 | 190 | 15.8 |
| Ex. 9 | Resin A (40) | Resin M (60) | 100 | 3.8 | 1.4 | 0.32 | 12.8 | 52.3 | 150 | 180 | 23.5 |
| Ex. 10 | Resin A (75) | Resin F (25) | 100 | 3.8 | 3.5 | 0.4 | 7.7 | 71.5 | 150 | 200 | 44.0 |
| Ex. 11 | Resin N (75) | Resin F (25) | 100 | 3.8 | 0.8 | 0.29 | 9.5 | 65.5 | 155 | 190 | 46.3 |
| Ex. 12 | Resin G (75) | Resin M (25) | 100 | 3.8 | 2.7 | 0.33 | 9.8 | 63.5 | 155 | 190 | 9.8 |
| Ex. 13 | Resin A (75) | Resin O (25) | 100 | 3.8 | 2.7 | 0.36 | 9.9 | 62.9 | 155 | 190 | 18.3 |
| Ex. 14 | Resin A (75) | Resin P (25) | 100 | 3.8 | 2.7 | 0.36 | 7.9 | 69.3 | 160 | 195 | 9.5 |
| Ex. 15 | Resin H (75) | Resin M (25) | 100 | 3.8 | 2.7 | 0.33 | 9.7 | 68.3 | 155 | 185 | 15.9 |
| Ex. 16 | Resin I (75) | Resin M (25) | 100 | 3.8 | 2.7 | 0.37 | 7.7 | 70.5 | 160 | 200 | 10.7 |
| Ex. 17 | Resin J (75) | Resin L (25) | 100 | 3.8 | 2.7 | 0.36 | 9.4 | 65.8 | 155 | 190 | 13.9 |
| Ex. 18 | Resin K (75) | Resin M (25) | 100 | 18.2 | 2.4 | 0.26 | 11.9 | 55.6 | 155 | 195 | 16.8 |
| Comp. Ex. 1 | Resin N (75) | Resin M (25) | 100 | 3.8 | 0.0 | 0.27 | 15.0 | 45.0 | 165 | 180 | 3.0 |
| Comp. Ex. 2 | Resin Q (75) | Resin R (25) | 100 | 0.0 | 2.5 | 0.47 | 23.2 | 33.3 | 160 | 180 | 50.2 |
| Comp. Ex. 3 | Resin S (75) | Resin T (25) | 80 | 3.8 | 2.4 | 0.32 | 19.8 | 38.7 | 160 | 185 | 52.2 |

X: The content of 1,2-propanediol (% by mol) in the alcohol component of all the polyesters.
Y: The content of the rosin compound (% by mol) in the carboxylic acid component of all the polyesters.
Z: The content of the aliphatic dicarboxylic acid compound having 6 to 10 carbon atoms (% by mol) in the carboxylic acid component of all the polyesters.

It can be seen from the above results in Table 4 that the toners of Examples 1 to 18 have a low pulverization pressure during pulverization, and suppressed amount of fine powders generated, thereby having a high pulverization and classification yield, as compared to the toners of Comparative Examples 1 to 3. In addition, the toners obtained have excellent low-temperature fixing ability, high-temperature offset resistance and heat-resistant storage property.

Examples 19 to 25

The same procedures as in Example 1 were carried out except that 2.0 parts by weight of the positively chargeable charge control agent "BONTRON P-51" and 4.0 parts by weight of the colorant "ECB-301" were changed to the charge control agent and the colorant listed in Table 5 to provide each of toners. Here, each of the toner matrix particles had a volume-median particle size $D_{50}$ of 7.0 μm. The results are shown in Table 5.

TABLE 5

| | Charge Control Agent | | | Colorant | | | Content of Particles | | Low-Temp. | High-Temp. | Heat-Resistant |
|---|---|---|---|---|---|---|---|---|---|---|---|
| | Charge Conrol Agent 1 (Parts by Weight) | Charge Conrol Agent 2 (Parts by Weight) | Charge Conrol Resin (Parts by Weight) | Colorant 1 (Parts by Weight) | Colorant 2 (Parts by Weight) | Pulverization Pressure (MPa) | Having Sizes of 3 μm or Less (% by Number) | Yield (%) | Fixing Ability (° C.) | Offset Resistance (° C.) | Storage Property (%) |
| Ex. 1 | 2 | 0 | 0 | 4 | 0 | 0.35 | 9.3 | 66.6 | 155 | 190 | 14.6 |
| Ex. 19 | 2 | 0 | 1 | 4 | 0 | 0.35 | 9.4 | 65.7 | 155 | 190 | 14.9 |
| Ex. 20 | 2 | 0 | 3 | 4 | 0 | 0.35 | 7.1 | 70.1 | 155 | 190 | 13.8 |
| Ex. 21 | 2 | 0 | 5 | 4 | 0 | 0.37 | 5.9 | 76.8 | 160 | 195 | 11.9 |
| Ex. 22 | 2 | 0 | 10 | 4 | 0 | 0.38 | 5.7 | 78.2 | 165 | 200 | 11.5 |
| Ex. 23 | 2 | 0 | 13 | 4 | 0 | 0.40 | 6.5 | 71.5 | 180 | 200 | 10.9 |

TABLE 5-continued

| | Charge Control Agent | | | Colorant | | | Content of Particles Having Sizes of 3 μm or Less | | | | |
|---|---|---|---|---|---|---|---|---|---|---|---|
| | Charge Conrol Agent 1 (Parts by Weight) | Charge Conrol Agent 2 (Parts by Weight) | Charge Conrol Resin (Parts by Weight) | Colorant 1 (Parts by Weight) | Colorant 2 (Parts by Weight) | Pulverization Pressure (MPa) | (% by Number) | Yield (%) | Low-Temp. Fixing Ability (° C.) | High-Temp. Offset Resistance (° C.) | Heat-Resistant Storage Property (%) |
| Ex. 24 | 2 | 0 | 5 | 0 | 4 | 0.36 | 5.1 | 81.2 | 155 | 190 | 12.3 |
| Ex. 25 | 0 | 4 | 5 | 0 | 4 | 0.37 | 5.3 | 80.9 | 155 | 190 | 12.7 |

Note 1)
Amounts in parts by weight are based on 100 parts by weight of the resin binder.
Note 2)
Charge Control Agent 1: commercially available from Orient Chemical Industries Co., Ltd., BONTRON P-51
Charge Control Agent 2: commercially available from Orient Chemical Industries Co., Ltd., BONTRON N-07
Charge Control Resin: commercially available from FUJIKURA KASEI CO., LTD., FCA-201PS, softening point: 125° C.
Colorant 1: C.I. Pigment Blue 15:3, commercially available from DAINICHISEIKA COLOR & CHEMICALS MFG. CO., LTD., ECB-301
Colorant 2: carbon black, commercially available from Cabot Corporation, Regal 330R It can be seen from the above results in Table 5 that the toners of Examples 19 to 25 contain a charge control resin, so that the toners have a further suppressed amount of fine powders generated, thereby having a high pulverization and classification yield and excellent heat-resistant storage property.

The toner for electrostatic image development obtained by the method of the present invention can be suitably used in, for example, the development or the like of latent image formed in electrophotography, an electrostatic recording method, an electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for producing a toner for electrostatic image development comprising at least a resin binder and a charge control agent, the method comprising:

melt-kneading components comprising a resin binder and a charge control agent to provide a melt-kneaded product; and pulverizing the melt-kneaded product, and classifying a pulverized product, wherein the resin binder comprises a polyester A obtained by polycondensing an alcohol component comprising 1,2-propanediol and a carboxylic acid component comprising a rosin compound and an aliphatic dicarboxylic acid compound having 6 to 10 carbon atoms, wherein 1,2-propanediol is contained in the alcohol component of the polyester A in an amount of 85% by mol or more, and wherein the resin binder comprises a polyester H having a softening point of from 125° to 155° C., and a polyester L having a softening point of from 90° to 125° C., wherein a difference in the softening points of the polyester H and the polyester L is 10° C. or more, and wherein at least one of the polyester H and the polyester L is the polyester A.

2. The method for producing a toner for electrostatic image development according to claim 1, wherein the polyester H is the polyester A.

3. The method for producing a toner for electrostatic image development according to claim 1, wherein the polyester L is a polyester B obtained by polycondensing an alcohol component comprising 1,2-propanediol and a carboxylic acid component comprising a rosin compound and but not comprising an aliphatic dicarboxylic acid compound having 6 to 10 carbon atoms.

4. The method for producing a toner for electrostatic image development according to claim 3, wherein the polyester A and the polyester B are contained in a total amount of 90% by weight or more of the resin binder.

5. The method for producing a toner for electrostatic image development according to claim 3, wherein the rosin compound in the polyester B is an unmodified rosin compound.

6. The method for producing a toner for electrostatic image development according to claim 3, wherein the rosin compound in the polyester B has an acid value of from 100 to 200 mg KOH/g.

7. The method for producing a toner for electrostatic image development according to claim 3, wherein a weight ratio of the polyester A and the polyester B, polyester A/polyester B, is from 30/70 to 95/5.

8. The method for producing a toner for electrostatic image development according to claim 1, wherein the rosin compound is contained in an amount of from 2.0 to 25% by mol of the carboxylic acid component of all the polyesters contained in the resin binder.

9. The method for producing a toner for electrostatic image development according to claim 1, wherein the aliphatic dicarboxylic acid compound having 6 to 10 carbon atoms is contained in an amount of from 0.5 to 8% by mol of the carboxylic acid component of all the polyesters contained in the resin binder.

10. The method for producing a toner for electrostatic image development according to claim 1, wherein the aliphatic dicarboxylic acid compound having 6 to 10 carbon atoms is at least one member selected from group consisting of a sebacic acid compound and an adipic acid compound.

11. The method for producing a toner for electrostatic image development according to claim 1, wherein the rosin compound in the polyester A is an unmodified rosin compound.

12. The method for producing a toner for electrostatic image development according to claim 1, wherein the rosin compound in the polyester A has a softening point of from 50° to 100° C.

13. The method for producing a toner for electrostatic image development according to claim 1, wherein the rosin compound in the polyester A has an acid value of from 100 to 200 mg KOH/g.

14. The method for producing a toner for electrostatic image development according to claim 1, wherein the charge control agent comprises a charge control resin.

15. The method for producing a toner for electrostatic image development according to claim 14, wherein the charge control resin is contained in an amount of from 2 to 12 parts by weight, based on 100 parts by weight of the resin binder.

16. The method for producing a toner for electrostatic image development according to claim 14, wherein the charge control resin is a quaternary ammonium salt-group containing a styrene-acrylic copolymer.

17. The method for producing a toner for electrostatic image development according to claim 16, wherein the quaternary ammonium salt-group containing a styrene-acrylic copolymer is a quaternary ammonium salt-group containing a styrene-acrylic copolymer obtained by polymerizing a mixture of a monomer represented by the formula (III):

(III)

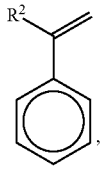

wherein $R^2$ is a hydrogen atom or a methyl group, a monomer represented by the formula (IV):

(IV)

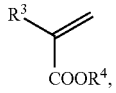

wherein $R^3$ is a hydrogen atom or a methyl group, and $R^4$ is an alkyl group having 1 to 6 carbon atoms, and a monomer represented by the formula (V):

(V)

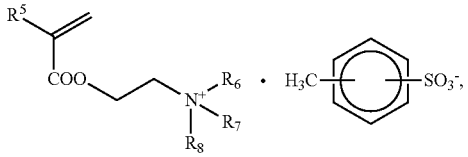

wherein $R^5$ is a hydrogen atom or a methyl group, and each of $R^6$, $R^7$, and $R^8$ is an alkyl group having 1 to 4 carbon atoms.

18. The method for producing a toner for electrostatic image development according to claim 1, wherein the melt-kneading comprises melt-kneading the components with a continuous open-roller type kneader.

* * * * *